US007146779B2

(12) United States Patent
Swiszcz et al.

(10) Patent No.: US 7,146,779 B2
(45) Date of Patent: Dec. 12, 2006

(54) METHOD OF PACKAGING AND SHIPPING COMPRESSIBLE STRUCTURAL PANELS

(75) Inventors: Paul G. Swiszcz, Niwot, CO (US); Ko Kuperus, Boulder, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/867,804

(22) Filed: Jun. 15, 2004

(65) Prior Publication Data

US 2004/0237441 A1 Dec. 2, 2004

Related U.S. Application Data

(63) Continuation-in-part of application No. 10/309,939, filed on Dec. 3, 2002, which is a continuation-in-part of application No. 09/970,008, filed on Sep. 27, 2001, now abandoned, which is a continuation of application No. 09/839,373, filed on Apr. 23, 2001, now abandoned.

(60) Provisional application No. 60/199,208, filed on Apr. 24, 2000.

(51) Int. Cl.
*B65B 63/02* (2006.01)
*B65B 63/08* (2006.01)
*B65B 35/50* (2006.01)

(52) U.S. Cl. ..... 53/438; 53/440; 53/447

(58) Field of Classification Search ..... 53/438, 53/447, 529, 540, 440, 127
See application file for complete search history.

(56) References Cited

U.S. PATENT DOCUMENTS 2,728,479 A * 12/1955 Wheeler ..... 217/35
2,896,207 A * 7/1959 Wilson ..... 53/397
3,225,509 A * 12/1965 May ..... 53/397
3,333,756 A * 8/1967 Amatel ..... 206/591
3,413,765 A * 12/1968 Williams et al. ..... 52/99
3,429,434 A * 2/1969 Hickin ..... 206/499
3,499,261 A * 3/1970 Hullhorst et al. ..... 53/430
4,090,384 A * 5/1978 Wootten ..... 72/186
4,182,237 A * 1/1980 O'Brien ..... 100/35
4,799,350 A * 1/1989 Rias ..... 53/399
4,948,445 A * 8/1990 Hees ..... 156/196
5,270,092 A * 12/1993 Griffith et al. ..... 428/69
5,667,871 A * 9/1997 Goodrich et al. ..... 428/136
5,799,455 A * 9/1998 Gates et al. ..... 52/323
5,979,145 A * 11/1999 Louis et al. ..... 53/439
6,205,728 B1 * 3/2001 Sutelan ..... 52/309.7
6,253,530 B1 * 7/2001 Price et al. ..... 52/793.1
6,652,613 B1 * 11/2003 Shah et al. ..... 55/497
6,708,465 B1 * 3/2004 Gustafsson ..... 53/463
2002/0020142 A1 * 2/2002 Swiszcz et al. ..... 52/783.1
2004/0005438 A1 * 1/2004 Lichodziejewski et al. . 428/166

FOREIGN PATENT DOCUMENTS

WO WO 9636536 * 11/1996

* cited by examiner

*Primary Examiner*—Stephen F. Gerrity
(74) *Attorney, Agent, or Firm*—Pitney Hardin LLP

(57) ABSTRACT

A method of packaging and shipping compressible structural panels is disclosed. Compressible structural panels are provided, typically with first and second sheets separated by compressible or collapsible dividers. The structural panels are stacked and thereafter compressed thereby causing the dividers to compress and the thickness of the panels to become substantially less. In this compressed and stacked configuration, the structural panels are packaged and shipped. At the point of installation of the structural panels, the structural panels are unpackaged, unstacked and allowed to regain the expanded configuration, either by way of natural resiliency or heat setting. The structural panels, once expanded, are ready for installation.

11 Claims, 46 Drawing Sheets

37/46

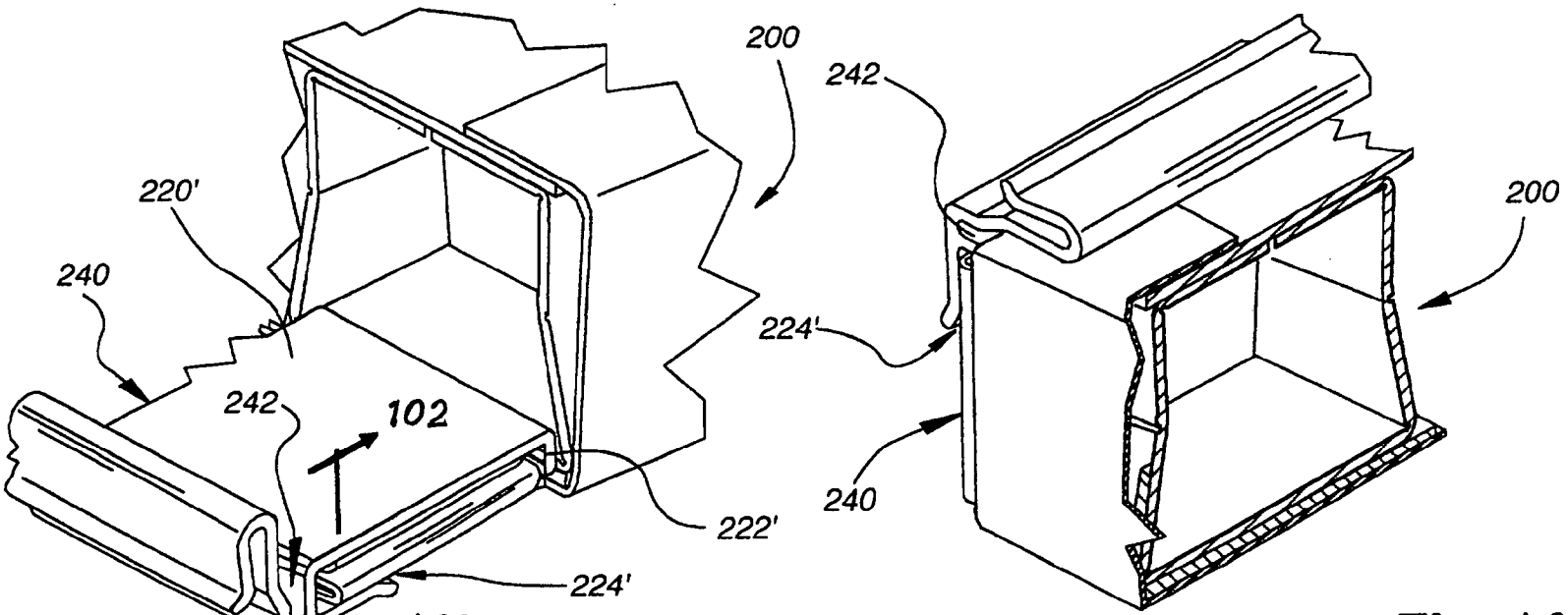
Fig. 103
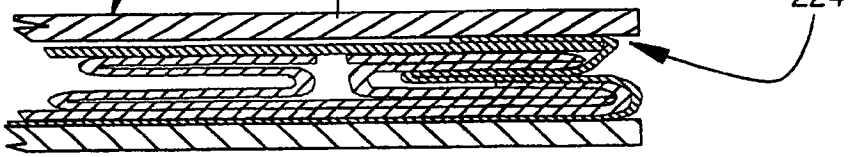
Fig. 102
Fig. 101

METHOD OF PACKAGING AND SHIPPING COMPRESSIBLE STRUCTURAL PANELS

CROSS-REFERENCE TO RELATED APPLICATIONS

This application is a continuation-in-part of U.S. application Ser. No. 10/309,939 filed on Dec. 3, 2002, which is a continuation-in-part of U.S. application Ser. No. 09/970,008 filed on Sep. 27, 2001, now abandoned, which is a continuation of U.S. application Ser. No. 09/839,373 filed on Apr. 23, 2001, now abandoned, which claims priority from U.S. Provisional application Ser. No. 60/199,208 filed on Apr. 24, 2000. This application is also related to U.S. application Ser. No. 10/309,944, filed on Dec. 3, 2002. All of the above-identified applications are hereby incorporated by reference as if fully disclosed herein.

BACKGROUND OF THE INVENTION

1. Field of the Invention

The invention of this application pertains to a method of packaging and shipping compressible structural panels, particularly ceiling panels or wall panels. In particular, the ceiling panels include an outer sheet and a connecting sheet which are spaced apart by spaced dividers. The dividers are compressible, yet resilient, allowing the thickness of the panel to be substantially reduced during packaging and shipping and further allowing the panel to regain its original dimensions after unpackaging. This reduction in volume during packaging and shipping can substantially reduce the packaging and shipping costs.

2. Description of the Prior Art

In the prior art, there is a plethora of structural panels for use as ceiling panels and wall panels. These structural panels have taken many forms, such as drywall or decorative or acoustic panels. However, these solid panels have virtually invariably been heavy and voluminous, thereby resulting in increased packaging and shipping costs. As the panels are typically shipped several times prior to installation—from the manufacturer to the wholesaler, from the wholesaler to the retailer, from the retailer to the installation site—the total shipping costs can be substantial.

OBJECTS AND SUMMARY OF THE INVENTION

It is therefore an object of the present invention to provide a method and apparatus for providing a structural panel which can be shipped at reduced expense.

It is therefore a further object of the present invention to provide a method and apparatus for providing a structural panel which has a reduced weight.

It is therefore a still further object of the present invention to provide a method and apparatus for providing a structural panel which has a reduced volume during shipping.

These and other objects are attained by providing a compressible structural panel which can be compressed prior to shipping in order to allow the panel to be shipped with reduced volume. The structural panel, upon being unpacked prior to installation, expands to regain its original shape and volume. Moreover, the compressible structural panel, whether in the compressed or uncompressed state, is very light as little material is used in order to achieve the compressibility.

In order to attain the low weight and the compressibility, along with the tendency to regain its original uncompressed configuration after unpackaging, the panels typically include an outer sheet of semi-rigid material with a plurality of dividers protruding from one face thereof. A connector in the form of a sheet or similar interconnecting system is secured to the distal edges of the dividers. The connector could take the form of a sheet or similar interconnecting system is secured to the distal edges of the dividers. The connectors could take the form of another sheet of material, strands of connective fibers, or the like.

The dividers are compressible in nature and could take numerous forms. In some embodiments, the dividers are elongated cells having foldable sides so that lateral or transverse pressure will compress the cells, and hence the divider, into a shallow space. The dividers can be formed from folding a strip of semi-rigid material such that the longitudinal sides or partitions fold inwardly or outwardly when the divider is compressed laterally. The dividers are constructed so as to normally assume an expanded or extended configuration and are resilient so as to return to that configuration after the compressed force has been removed.

A panel formed in accordance with the present disclosure for use in the packaging and shipping method will assume an expanded configuration in its normal at-rest configuration. However, when pressure with a perpendicular component is applied to the outer sheet or the connector, the dividers are compressed thereby allowing the entire panel to assume a very thin thickness or profile. When the structural panel is being compressed, there typically should be very little, if any, sliding movement between the outer and connector sheets. This is advantageous for shipping purposes as a greater number of panels can be packaged in a container than is possible with prior art panels that have a uniform thickness during shipping and use. The panels, particularly in the uncompressed state, are predominantly air filled and, therefore, are very lightweight.

In particular, the present invention involves packaging the panels in a compressed configuration prior to shipping, and allowing the panels to regain their original shape upon unpackaging, typically after shipping and immediately prior to installation.

BRIEF DESCRIPTION OF THE DRAWINGS

Further objects and advantages will become apparent from the following description and claims, and from the accompanying drawings, wherein:

FIGS. 92A–95A are views identical to FIGS. 92–95, respectively, showing an alternative system for mounting a clip to the end of a panel with the end of the panel being compressed in a manner to replace the stiffener strip used in FIGS. 92–95.

FIG. 101 is a fragmentary isometric showing an alternative clip embodiment connected to the end of a panel.

FIG. 102 is an enlarged fragmentary section taken along line 102—102 of FIG. 101.

FIG. 103 is a fragmentary isometric showing the clip being moved into a closed position at the end of the associated panel.

DETAILED DESCRIPTION OF THE PREFERRED EMBODIMENT

At the outset, the panels disclosed herein are disclosed in the parent application, Ser. No. 10/309,939 filed on Dec. 3, 2002, the contents of which have been incorporated herein by reference.

Figure 1:
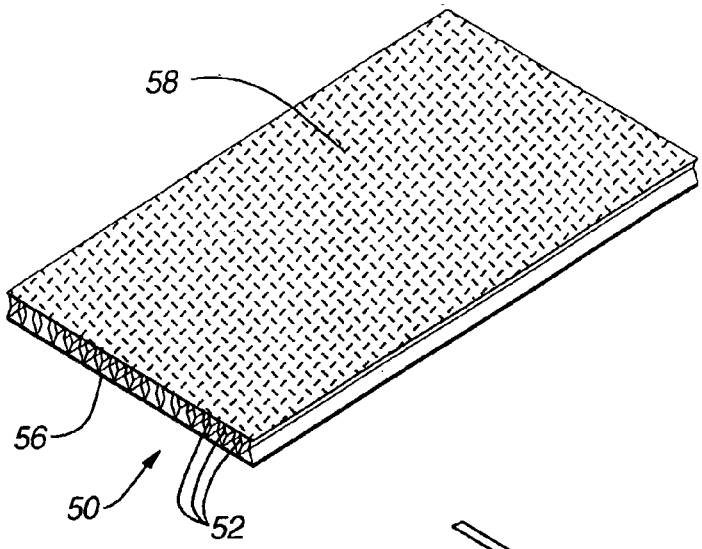
FIG. 1 is an isometric view of a panel formed in accordance with the present disclosure for use with the packaging and shipping method of the present invention.
Figure 12:
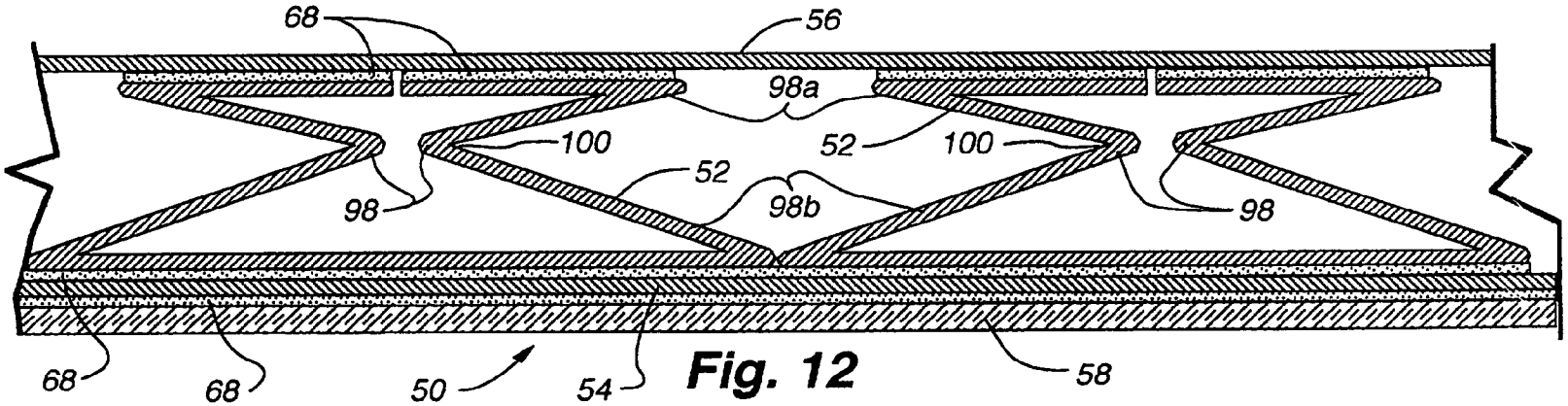
FIG. 12 is a fragmentary end elevation of a panel formed in accordance with the present disclosure for use with the packaging and shipping method of the present invention and with a decorative layer of material being adhesively secured to the outer sheet of the panel.
Figure 17:
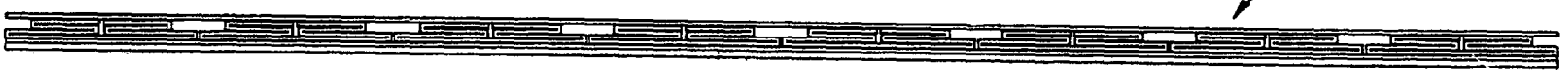
FIG. 17 is an end elevation similar to FIG. 16 with the panel being fully compressed.
Figure 18:
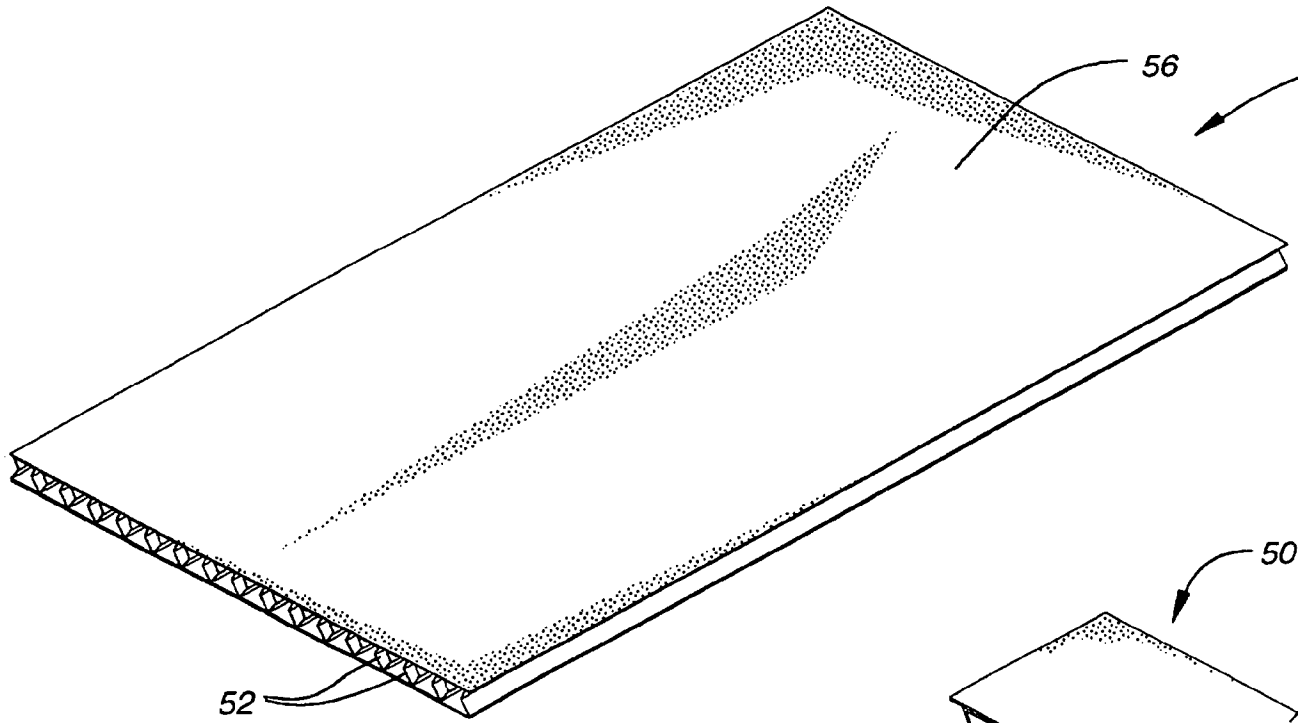
FIG. 18 is an isometric view of the panel as shown in FIG. 14.
Figure 19:
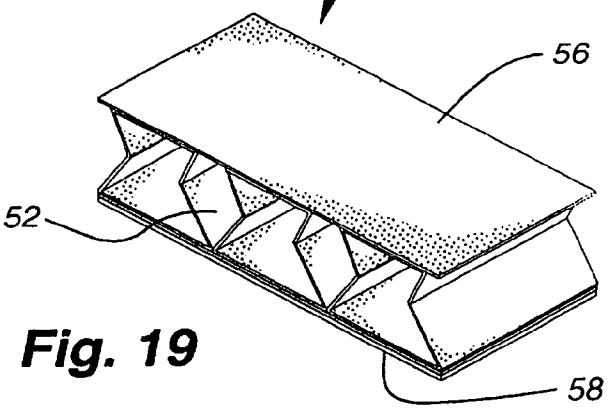
FIG. 19 is an enlarged isometric view of a portion of the panel shown in FIG. 18.
Figure 20:
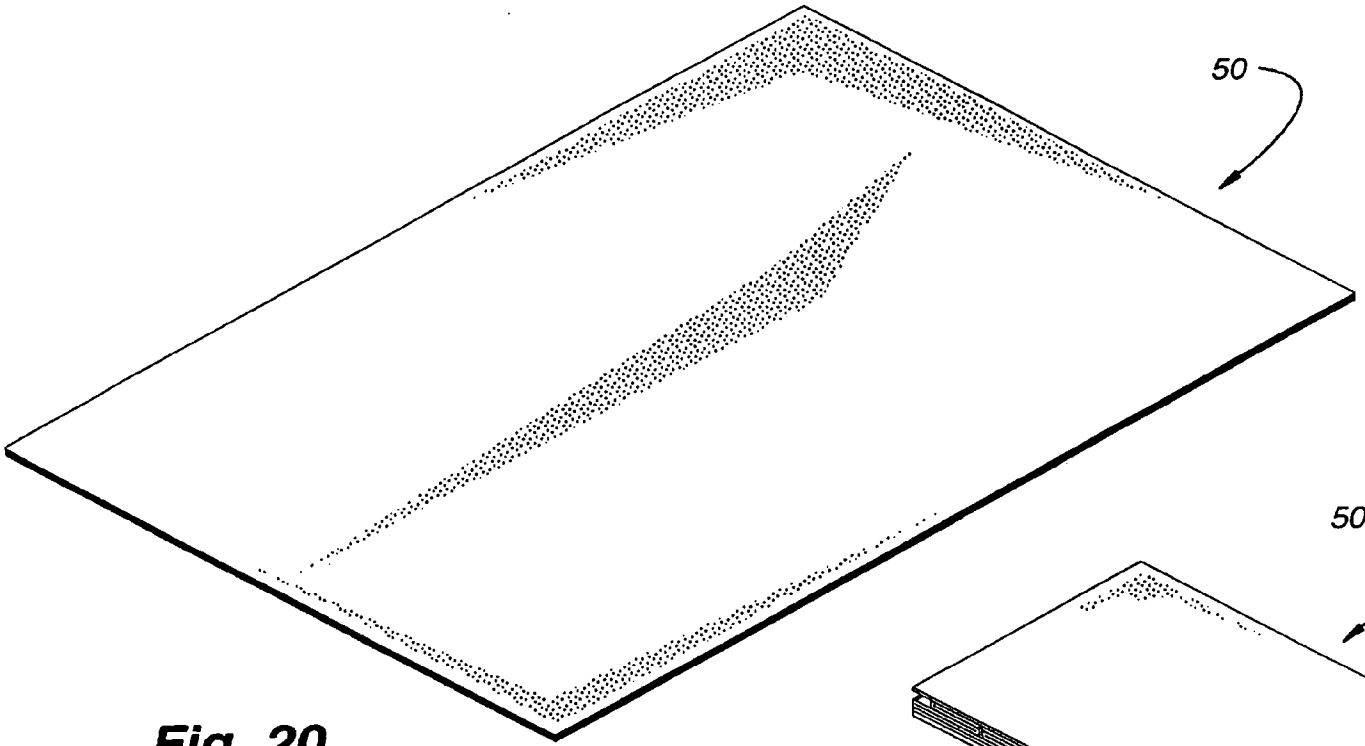
FIG. 20 is an isometric view of the panel shown in FIG. 18 in a fully compressed condition.
Figure 21:
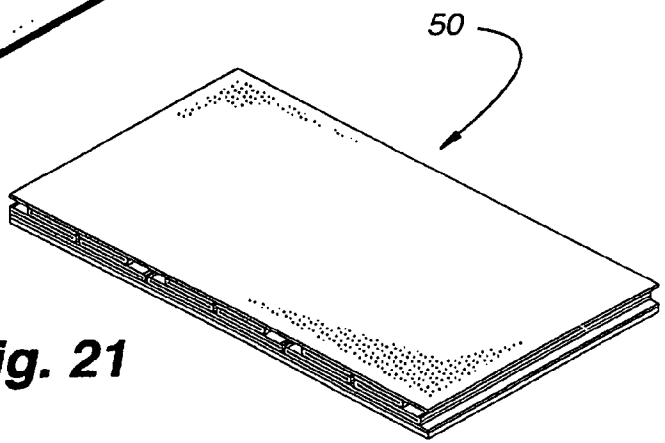
FIG. 21 is an enlarged isometric view of a portion of the panel as seen in FIG. 20.

Referring now to the drawings in detail wherein like numerals refer to like elements throughout the several views, one sees that FIGS. 1 and 12 show a typical compressible structural panel 50 which may be used with the invention of the present method. Compressible panel 50 includes a plurality of compressible parallel dividers or beams 52 extending between an outer sheet 54 (see FIG. 12) and a connector sheet 56. A decorative sheet may be provided to overlie the outer sheet 54. Compressible structural panel 50 is compressible from its normal expanded condition shown in FIGS. 1 and 12 to a fully compressed condition as shown in FIG. 17. Particularly in its normal expanded state, the panel is comprised mostly of air and is, therefore, very light and easy to handle.

Figures 22, 23:
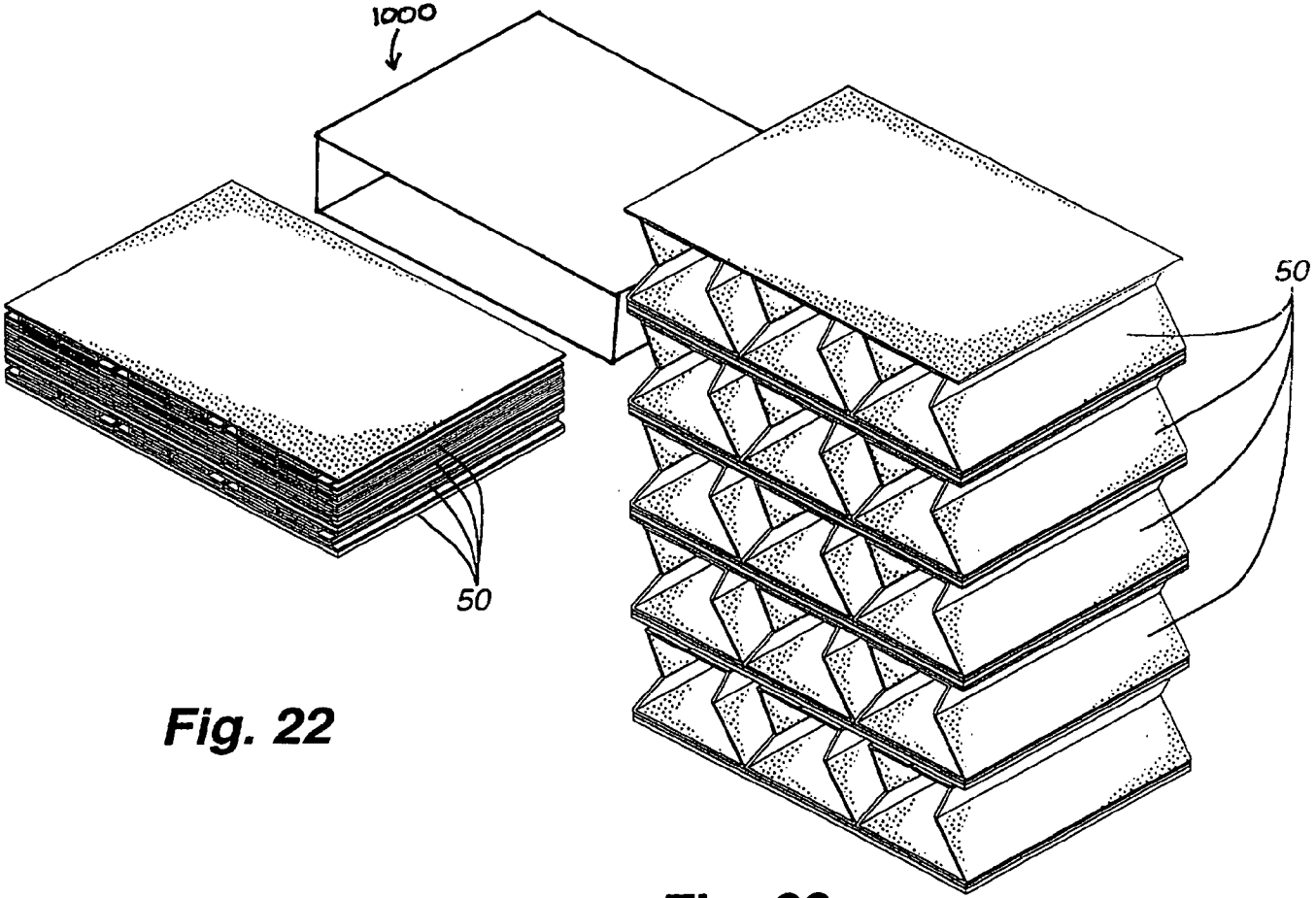
FIG. 22 is an isometric view of a plurality of panels stacked together while in a compressed condition.
FIG. 23 is an isometric view of the panels shown in FIG. 22 in an expanded condition.

FIGS. 22 and 23 illustrate the method of the present invention. Firstly, a stack of uncompressed panels 50 is provided as shown in FIG. 23. Then, pressure or some similar method is used to compress the stack of panels 50 to the configuration shown in FIG. 22. Then, a package 1000 is formed around the stack of compressed panels 50 by methods that would be known to those skilled in the art after review of the present disclosure. Package 1000 is then shipped. A plurality of these packages can be shipped from a manufacturer to a wholesaler. The wholesaler can then send a portion of the plurality of packages to any number of retailers. The retailers can then further divide the received packages into smaller groups of packages and send these smaller groups of packages to any number of customers, typically at a site of installation. Alternatively, with the increased ease of packaging and shipping these packages, a wholesaler may even ship directly to the retail sites or points of installation, particularly after receiving an order from an electronic system, such as the internet, by accessing a website or receiving an e-mail. After the packages are received, the packaging is removed so that panels 50 can reach the expanded configuration, either by way of natural resilience or by way or the application of heat, as described herein.

Figure 2:
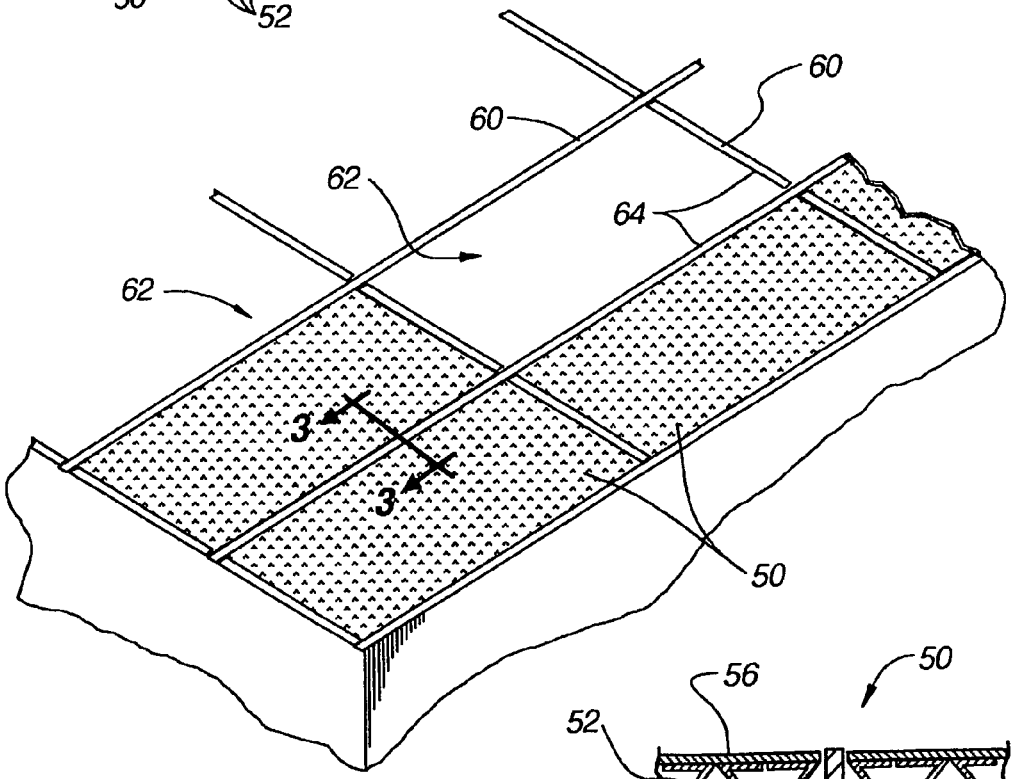
FIG. 2 is a fragmentary isometric view looking upwardly at a drop ceiling in a building structure, with the panels of FIG. 1 incorporated therein.
Figure 3:
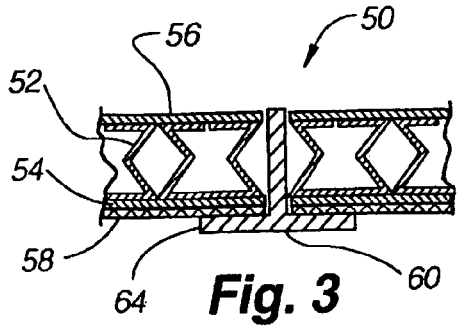
FIG. 3 is an enlarged fragmentary section taken along line 3—3 of FIG. 2.

The panel 50 has many possible embodiments, examples of which will be described hereinafter. Further, these embodiments can take many forms, such as a wall panel, a fixed ceiling panel, or panels for a drop ceiling such as shown in FIGS. 2 and 3 wherein a gridwork of elongated inverted T-shaped support members 60 are conventionally supported from a ceiling thereby defining rectangular openings 62 and peripheral support edges 64 around those openings on which a ceiling tile or panel 50 can be positioned.

Figure 4:
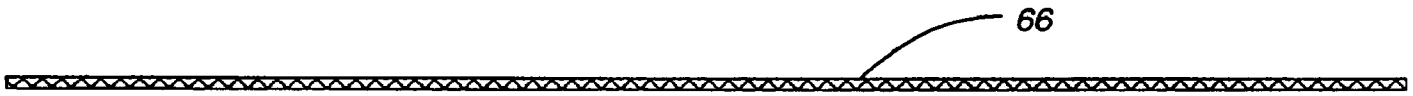
FIG. 4 is a front elevation of a strip of material from which a divider of the panel is made.

As shown in FIG. 12, dividers 52 are formed from the individual strips of material shown in FIG. 4 which have been pre-creased and folded into a desired configuration so that when incorporated into the panel 50 are transversely compressible allowing the panels to be compressed for packaging and shipping. Outer sheet 54, connector sheet 56 and dividers 52 may be made from the same or different materials, and are typically held together by adhesive 68.

The dividers 52, shown in cross section in FIG. 12, might be formed from a continuous strip of material but in the disclosed embodiment are each individual dividers of an elongated cellular or tubular configuration.

Figure 5:
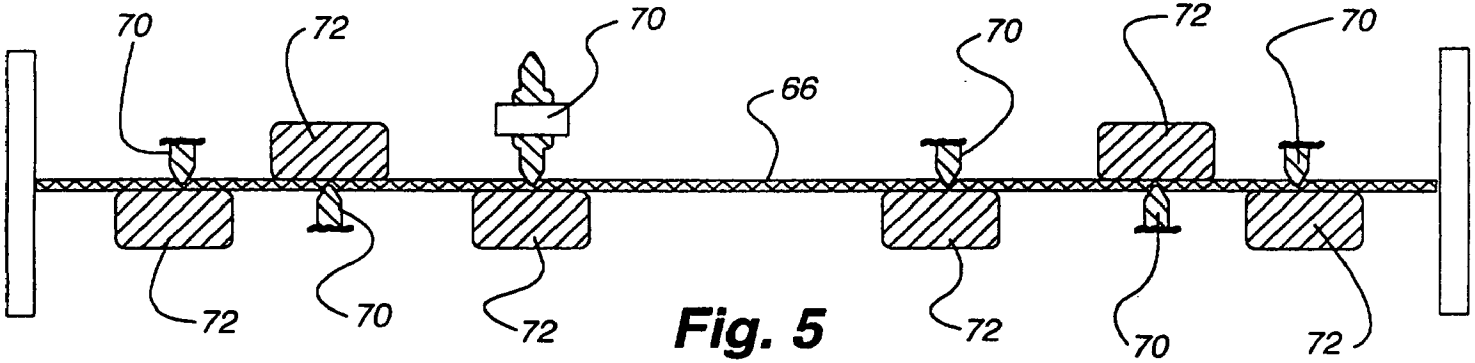
FIG. 5 is a front elevation of the strip of material shown in FIG. 4 being creased to form pre-fold lines.
Figure 6:
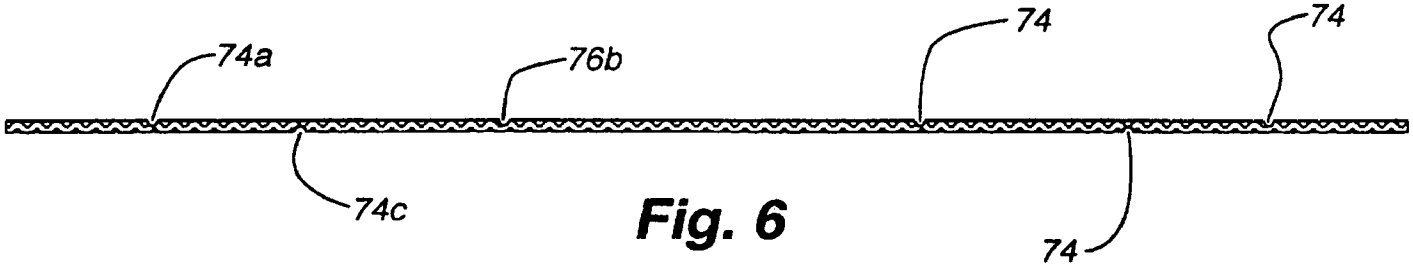
FIG. 6 is a front elevation of the strip of material shown in FIG. 4 after having been creased as shown in FIG. 5.
Figure 7:
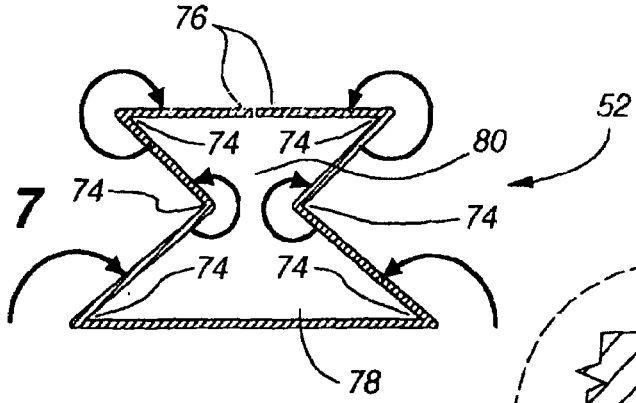
FIG. 7 is a front elevation of the strip of material shown in FIG. 6 having been folded along the preformed fold lines.
Figure 8:
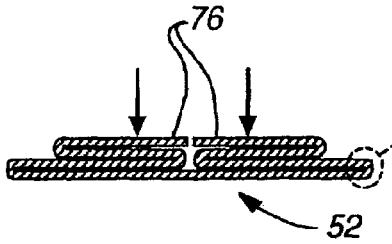
FIG. 8 is a front elevation of the divider as shown in FIG. 7 having been compressed.
Figure 8A:
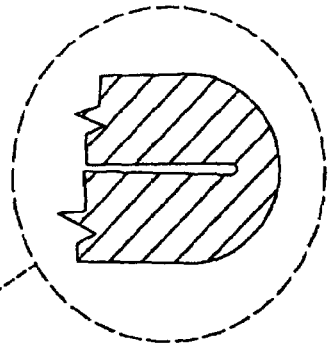
FIG. 8A is an enlarged section of the circled area of FIG. 8.

FIG. 4 illustrates the flat strip 66 before being passed into the creaser of FIG. 5. In the crease, the material is passed between rotary creasing wheels 70 and back up rollers 72 so that longitudinally extending creases 74 (including 74*a*, 74*b*, 74*c* as shown in FIG. 6) are formed in the material at predetermined laterally spaced locations. Strip 66 is then folded into the configurations illustrated in FIGS. 7, 8 and 8A. As shown in FIG. 7, typically lower triangle 78 has a broader base than the upper triangle 80. Applying pressure to the cell as configured in FIG. 7 in a vertical direction causes the components of the cell to compress so that the divider assumes the compressed configuration as shown in FIG. 8. Typically, adhesive 68 is applied when the cell is in the compressed configuration.

Figure 10:
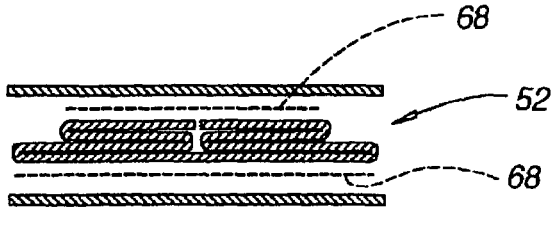
FIG. 10 is a front elevation similar to FIG. 9 with an outer sheet and a connector sheet being positioned above and below the layers of adhesive.
Figure 11:
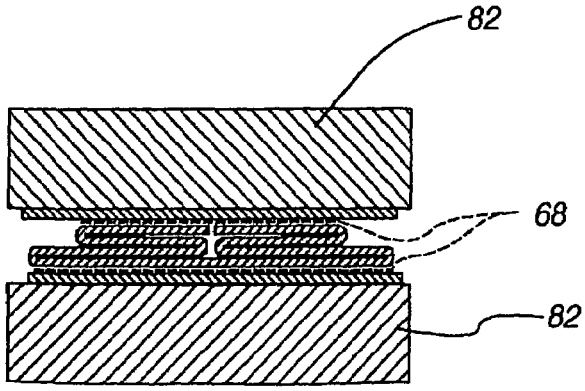
FIG. 11 is a front elevation showing the composite illustrated in FIG. 10 being heat compressed between heating elements.

As shown in FIG. 10, the divider 52 with adhesive 68 applied to its upper and lower faces is passed between the outer sheet 54 and the connector sheet as shown in FIG. 11, the entire laminate is then compressed between heated plates 82 which activate the adhesive 68 in the case of thermoplastic adhesives or act as a catalyst in the case of thermosetting adhesives.

If a thermosetting resin is used in bonding the glass fibers within the strips 66 and sheets 54 and 56 of material, the panel will naturally expand to its preformed condition, as shown in FIG. 12, after having been compressed and bonded together. If a thermoplastic resin is used, it will remain compressed but need only be reheated and the strips will inherently expand under the heat. The panel can either inherently expand or be selectively expanded to a desired height or thickness.

Figure 13:
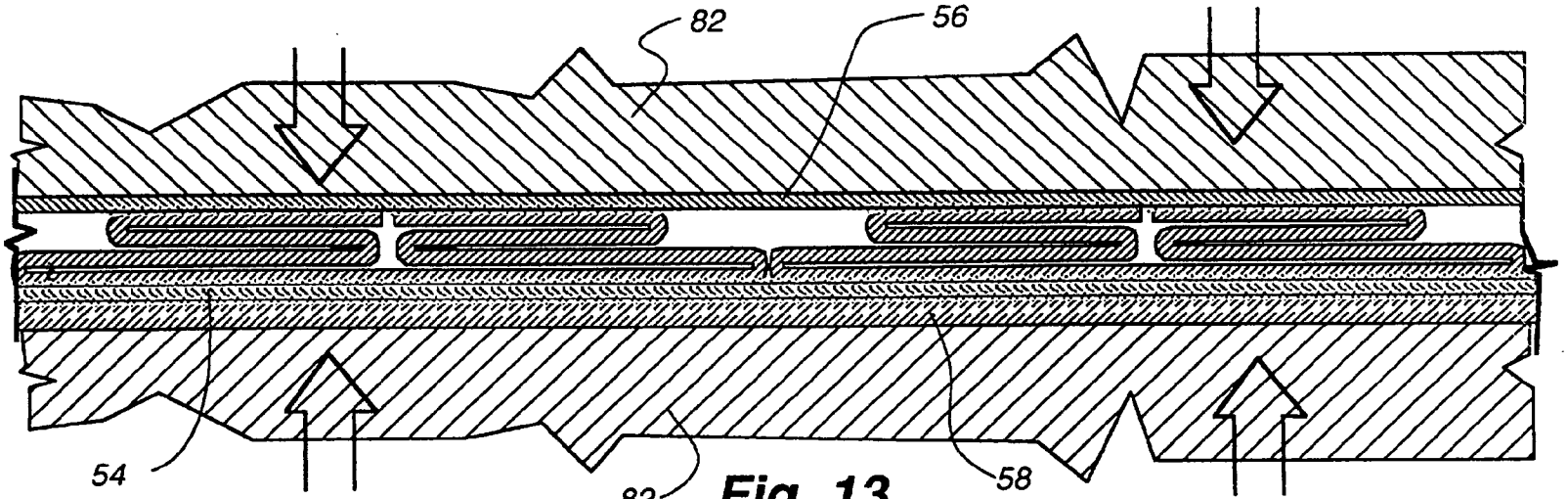
FIG. 13 is a fragmentary end elevation of the panel as shown in FIG. 12 being compressed between heated press elements.
Figure 14:
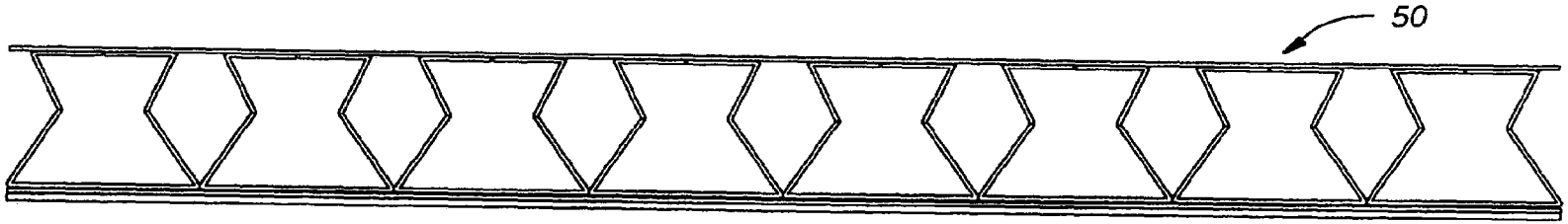
FIG. 14 is an end elevation of a panel as shown in FIG. 12 having dividers with asymmetric partitions and with the panel fully expanded.
Figure 15:
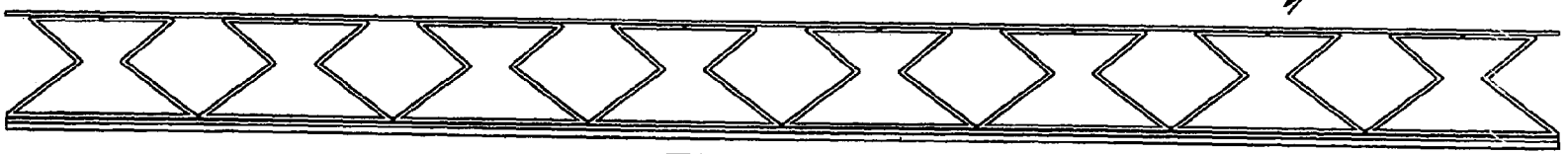
FIG. 15 is an end elevation similar to FIG. 14 with the panel being partially compressed.
Figure 16:
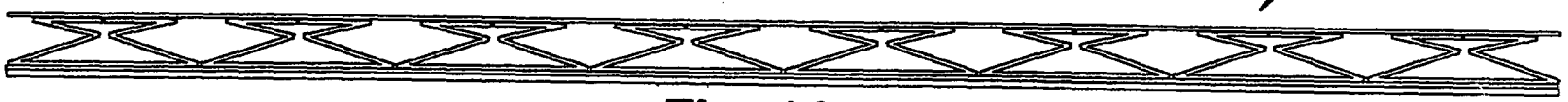
FIG. 16 is an end elevation similar to FIG. 15 with the panel being slightly further compressed.

As shown in FIG. 13, the decorative sheet 58 could also be positioned between the outer sheet 54 and the heat press 82 with a suitable adhesive therebetween the bond the decorative sheet to the outer sheet thereby resulting in the panel illustrated in FIG. 12.

FIGS. 14–17 illustrate the assembled panel in progressively compressed configurations.

A problem with conventional ceiling panels of the prior art is that they remain the same size and thickness during shipment, installation and use. However, with the present invention, the panels are compressed for shipping purposes so that far more panels can be packed in one container for shipping purposes thereby substantially reducing the volume shipped thereby substantially reducing shipping costs. Moreover, the light weight design of the panels described herein substantially reduces the shipping weight. Upon unpackaging, typically immediately prior to installation, the panels 50 can be allowed to naturally regain their original configuration or in some embodiments, as described hereinabove, a heater can be used to vary the thickness of the final panel.

Figure 24:
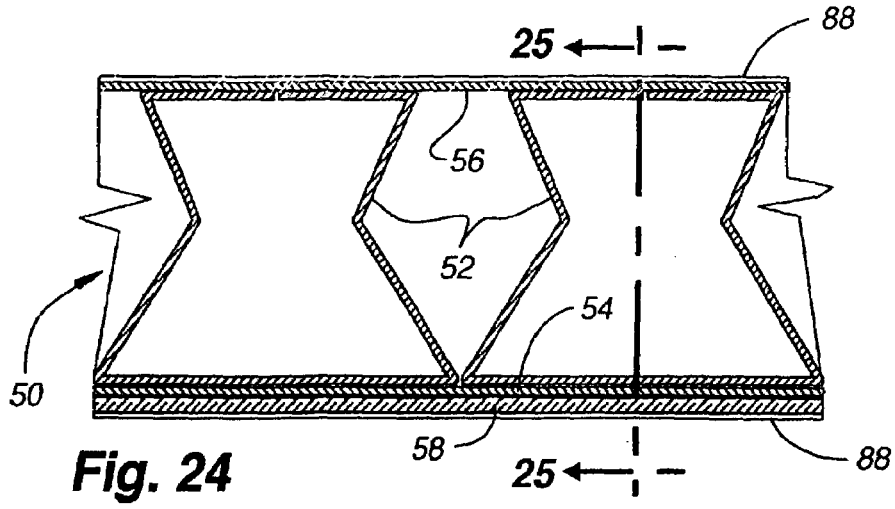
FIG. 24 is an enlarged fragmentary end elevation of the panel shown in FIG. 14 with end supports for the panel to inhibit the panel from bending.
Figure 25:
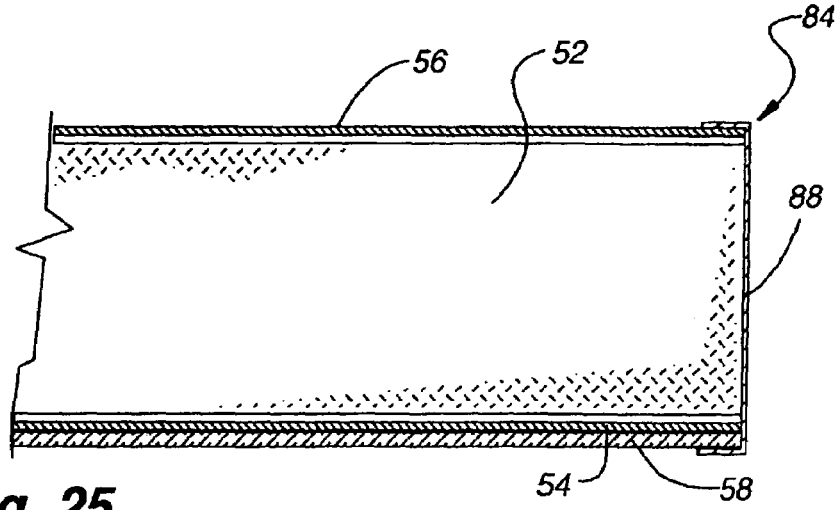
FIG. 25 is a fragmentary section taken along line 25—25 of FIG. 24.
Figure 26:
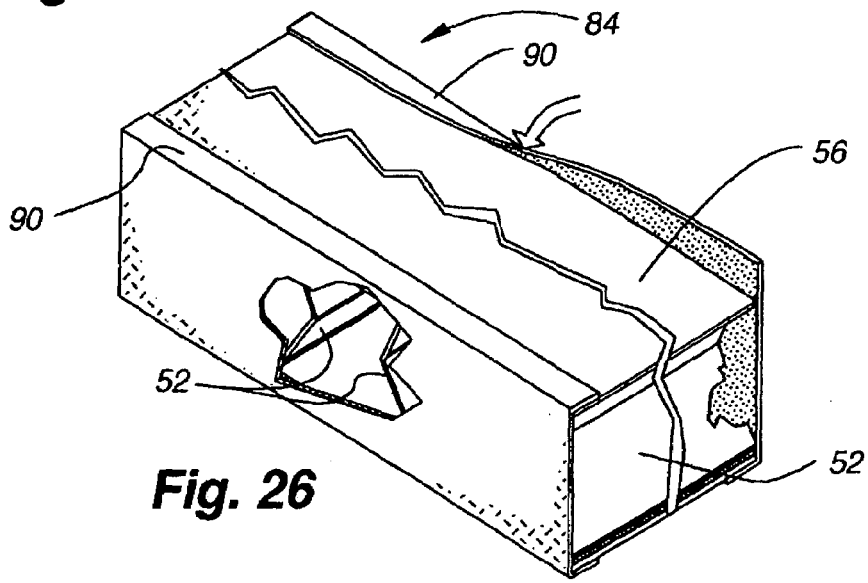
FIG. 26 is a fragmentary isometric with parts removed showing an end support on one end of the panel and a second end support being installed on the opposite end of the panel.
Figure 31:
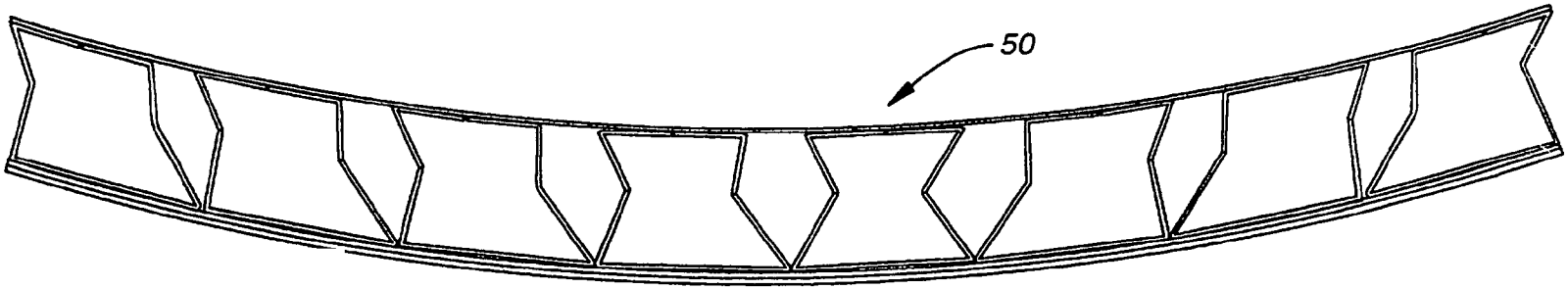
FIG. 31 is an end elevation of the panel shown in FIG. 14 with the panel being curved concave upwardly.
Figure 32:
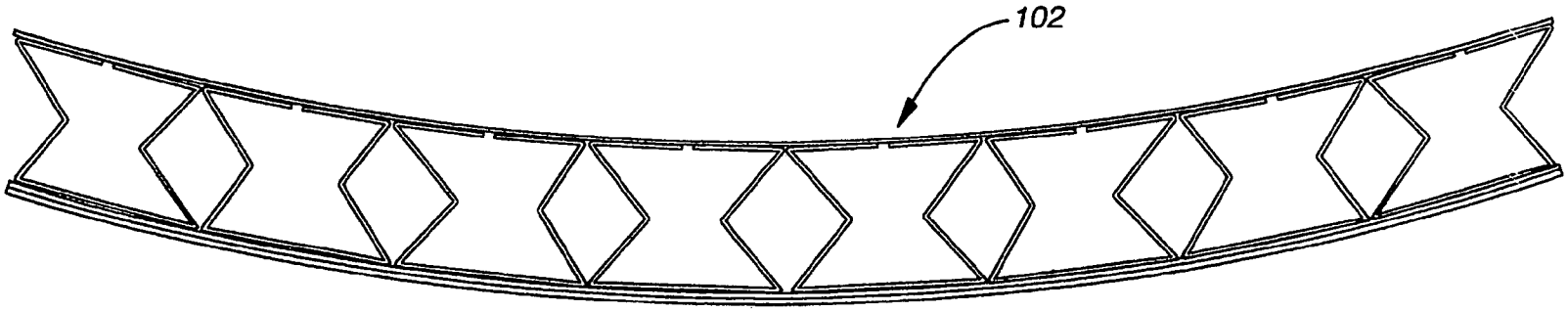
FIG. 32 is an end elevation of a panel in accordance with a second embodiment of the panel wherein the partitions of the dividers are symmetric rather than asymmetric as shown in FIG. 31.
Figure 65:
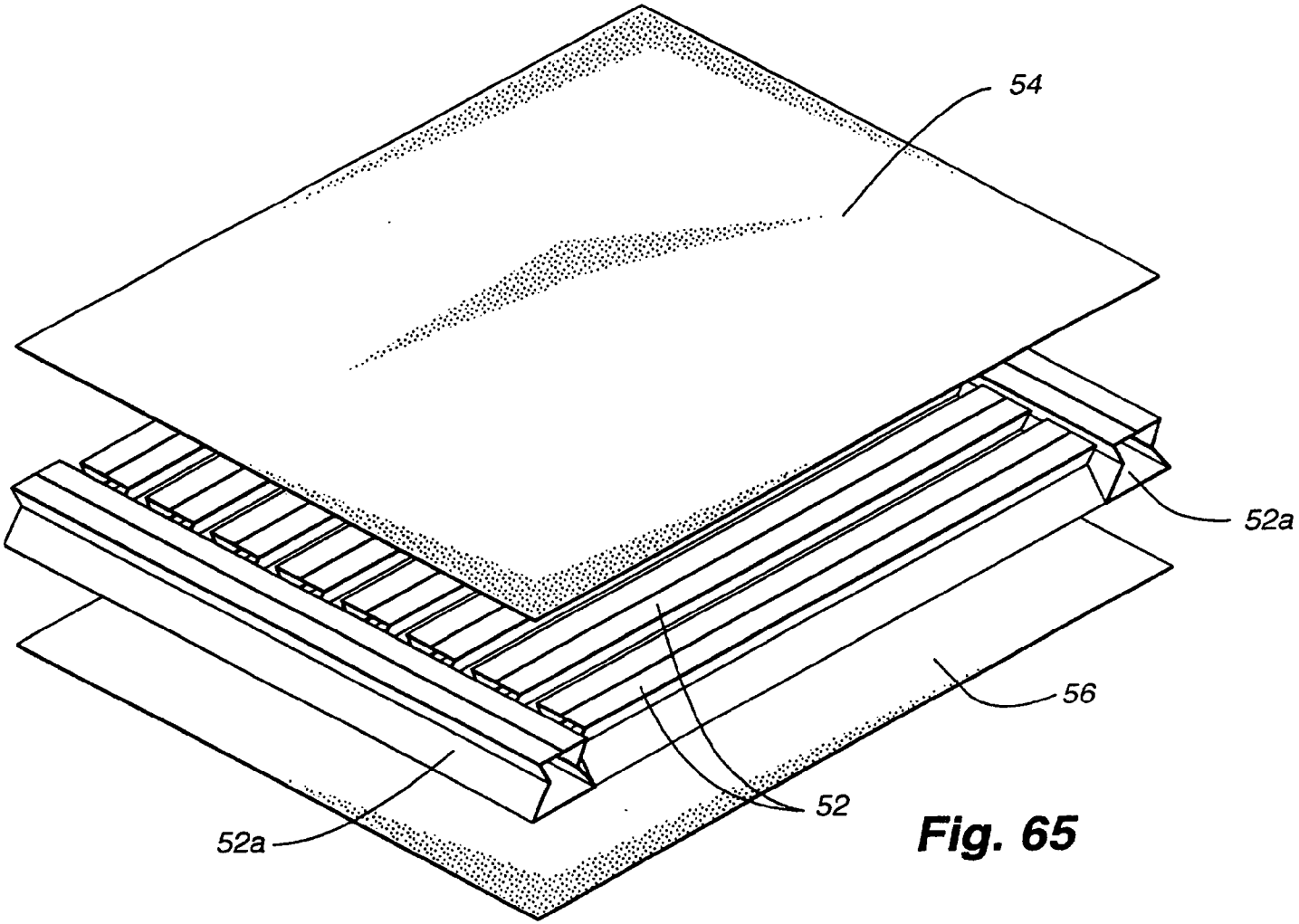
FIG. 65 is an exploded isometric view of a panel similar to that shown in FIG. 1 that has been rigidified by providing additional dividers at the ends of the panel that extend perpendicular to the primary dividers.
Figure 67:
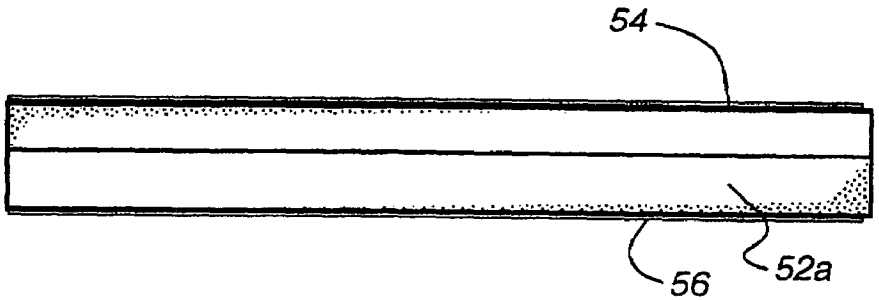
FIG. 67 is an end elevation of the panel shown in FIG. 65.
Figure 66:
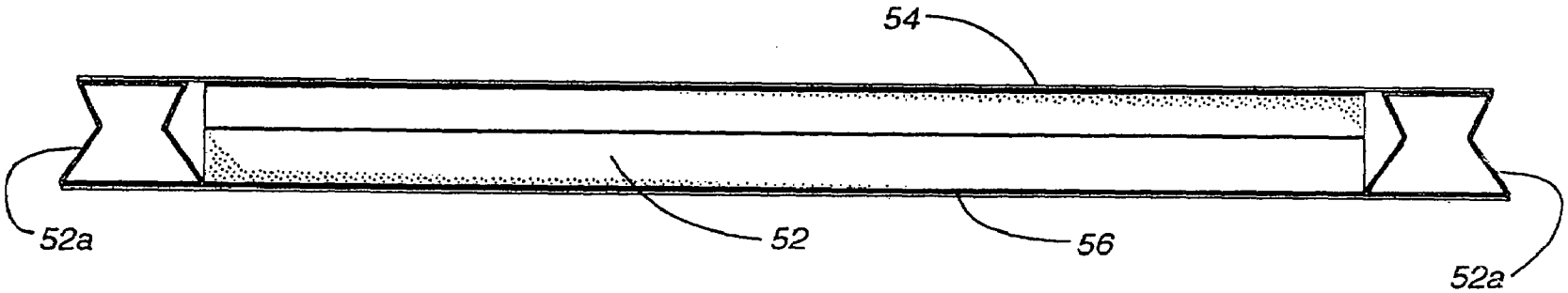
FIG. 66 is a side elevation of the panel shown in FIG. 65.

As shown in FIG. 31, panel 50 can be easily flexed or bent transversely of the direction in which the elongated dividers 52 extend to facilitate the insertion of the panel into the support structure of a drop ceiling. However, as illustrated in FIGS. 24 and 25, panel 50 can be made substantially more rigid by placing support members 84 at opposite ends of the panel so as to cover the open ends 86 of the tubular or cellular dividers. Support members 84 can be preformed C-shaped channel members 88 as shown in FIGS. 24 and 25 or strips 90 of adhesive material as shown in FIG. 26. Similarly, as shown in FIGS. 65–67, a divider 52*a* could be placed at each end of the panel to cover the open ends of the parallel dividers 52. The outer sheet 54 and connector sheet 56 are extended to cover the dividers 52 which serve to make the panel 50 more rigid in the cross-direction.

Figure 28:
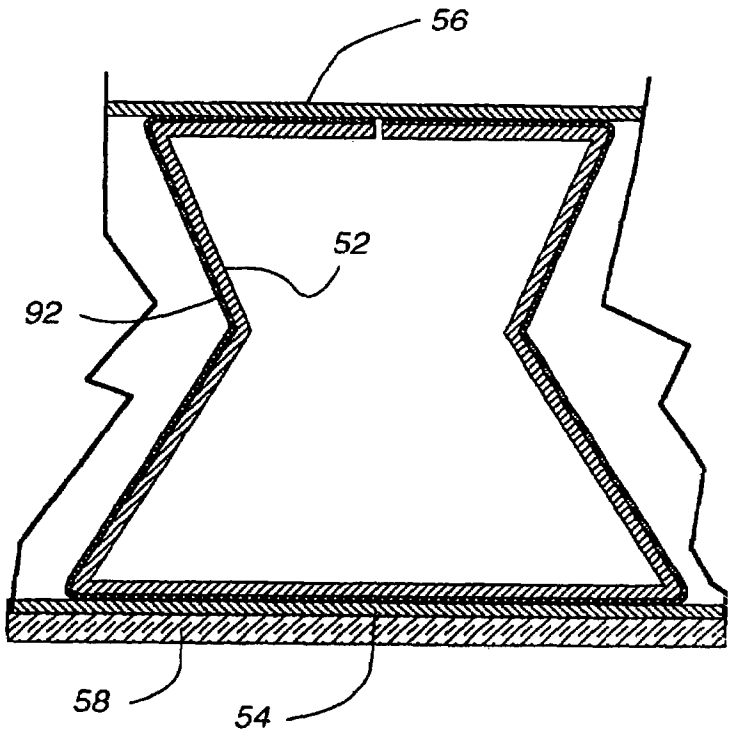
FIG. 28 is a fragmentary vertical section taken through the panel similar to FIG. 27 showing still another alternative arrangement of the divider wherein a metal foil is applied to the outer surface of the divider.
Figure 27:
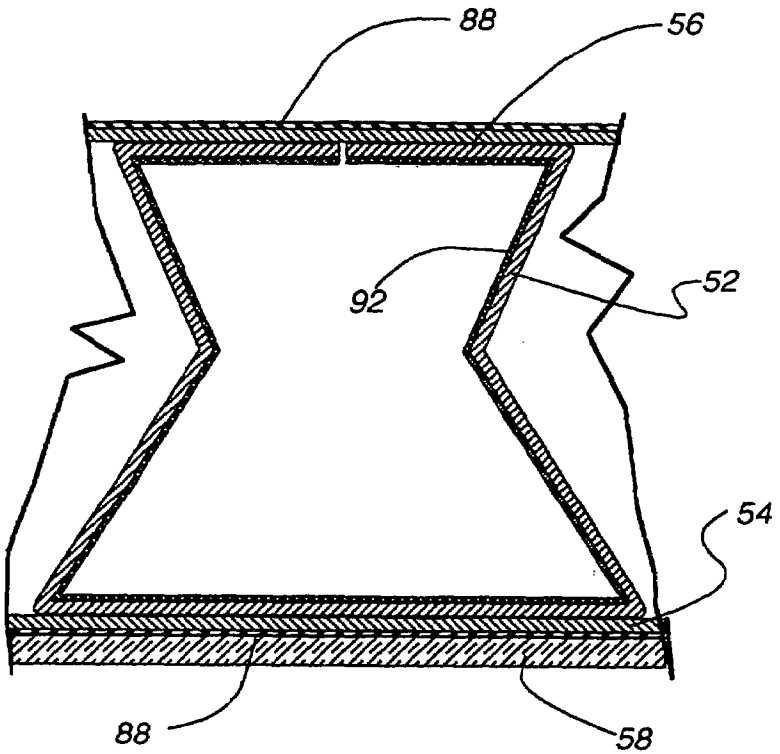
FIG. 27 is a fragmentary vertical section taken through a portion of the panel illustrating an alternative embodiment of the divider wherein the divider includes an inner layer of a metallic foil.

The structural characteristics of divider 52 can be varied by laminating the inner or outer surface of the divider with another sheet of material and possibly a metallic sheet material 92, as shown in FIGS. 28 and 27, respectively.

Figure 29:
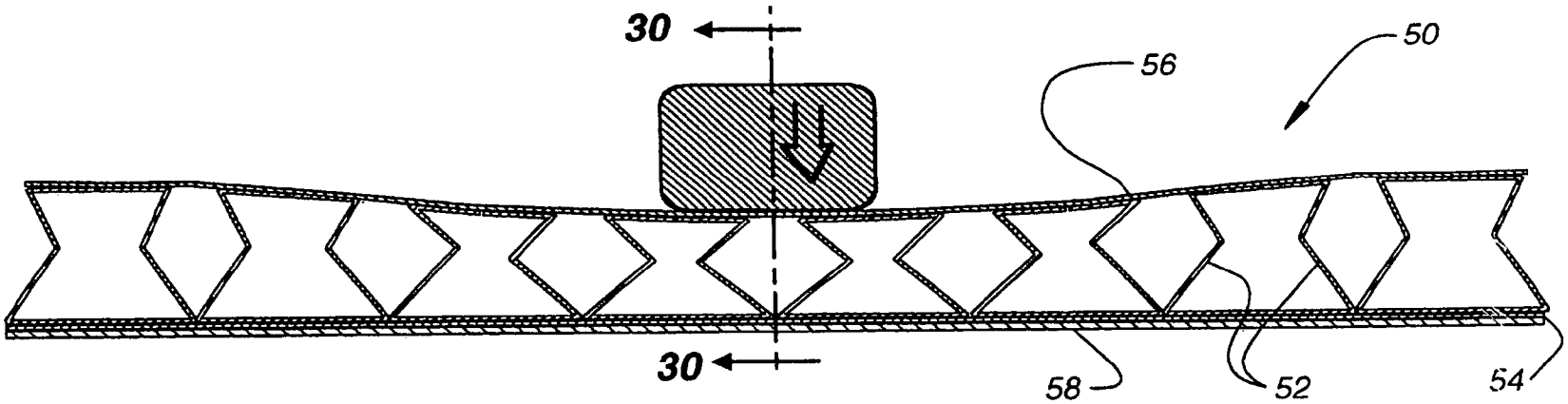
FIG. 29 is a transverse section taken through the panel as shown in FIG. 14 with the panel being compressed on its top surface.
Figure 30:
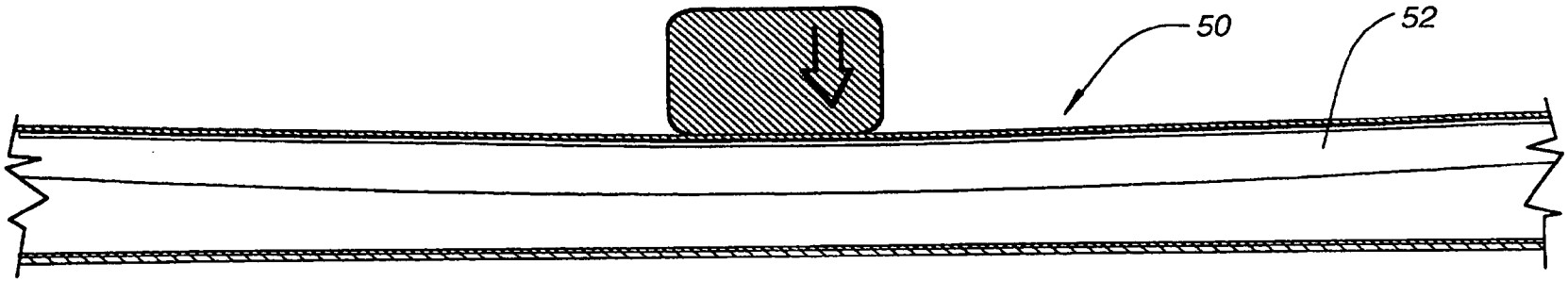
FIG. 30 is a section taken along line 30—30 of FIG. 29.

As shown in FIGS. 29 and 30, pressure applied to one side of the panel 50 will not deform the opposite of the panel 50.

Figure 33:
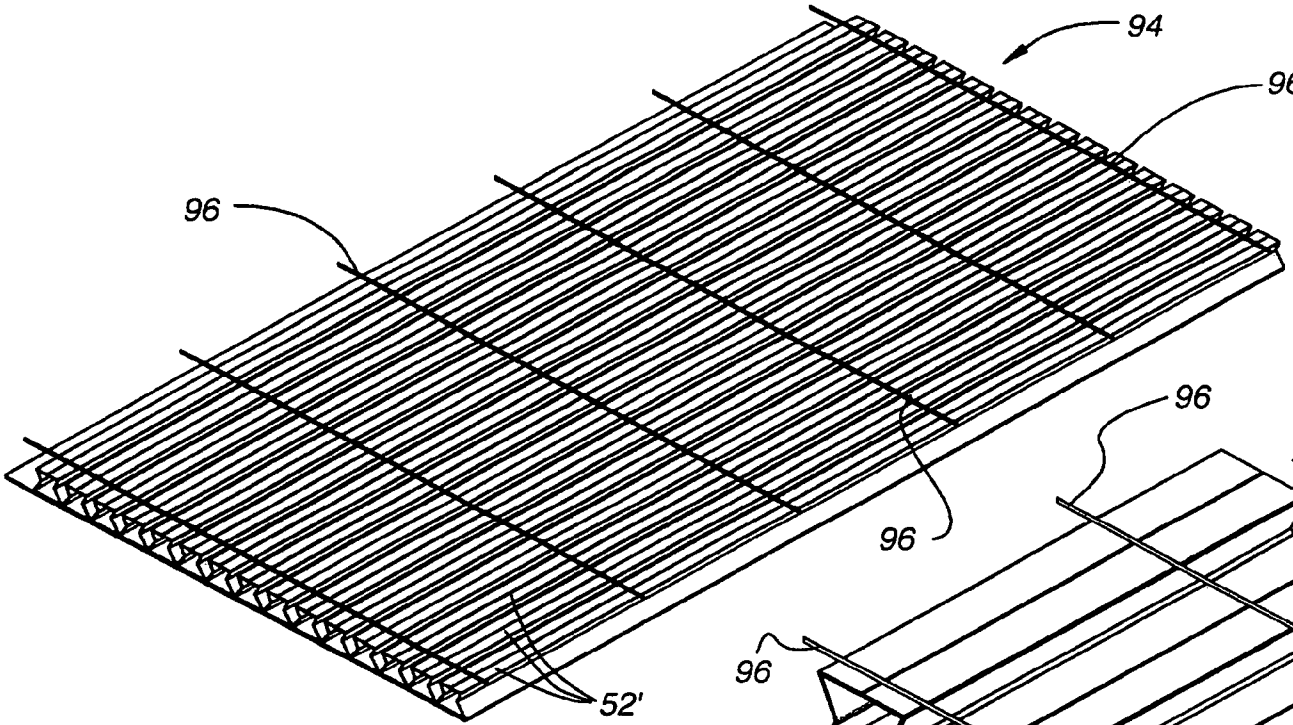
FIG. 33 is an isometric view showing a panel in accordance with the present disclosure for use with the packaging and shipping method of the present invention wherein the connection means are elongated strands or fibers that are secured to the dividers distally from the outer sheet.
Figure 34:
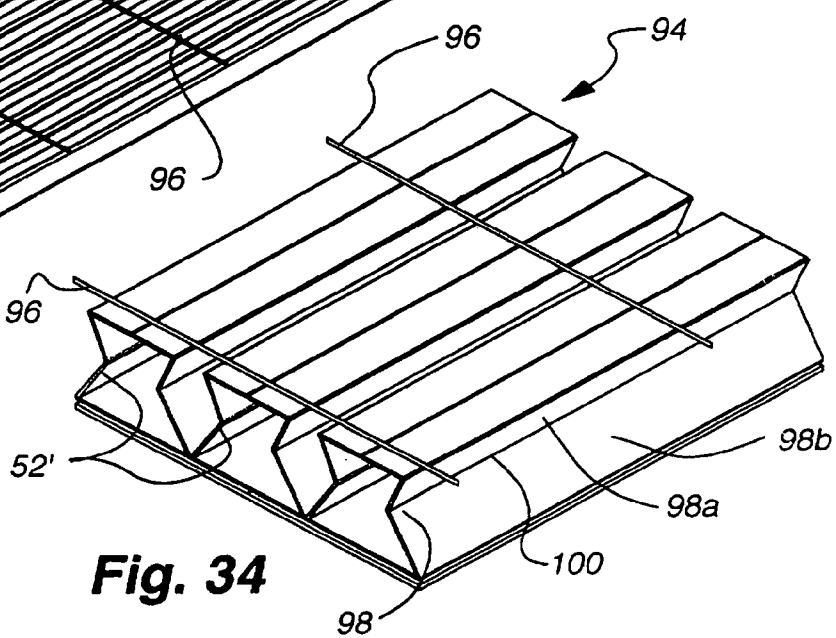
FIG. 34 is an enlarged isometric showing a portion of the panel illustrated in FIG. 33.
Figure 35:
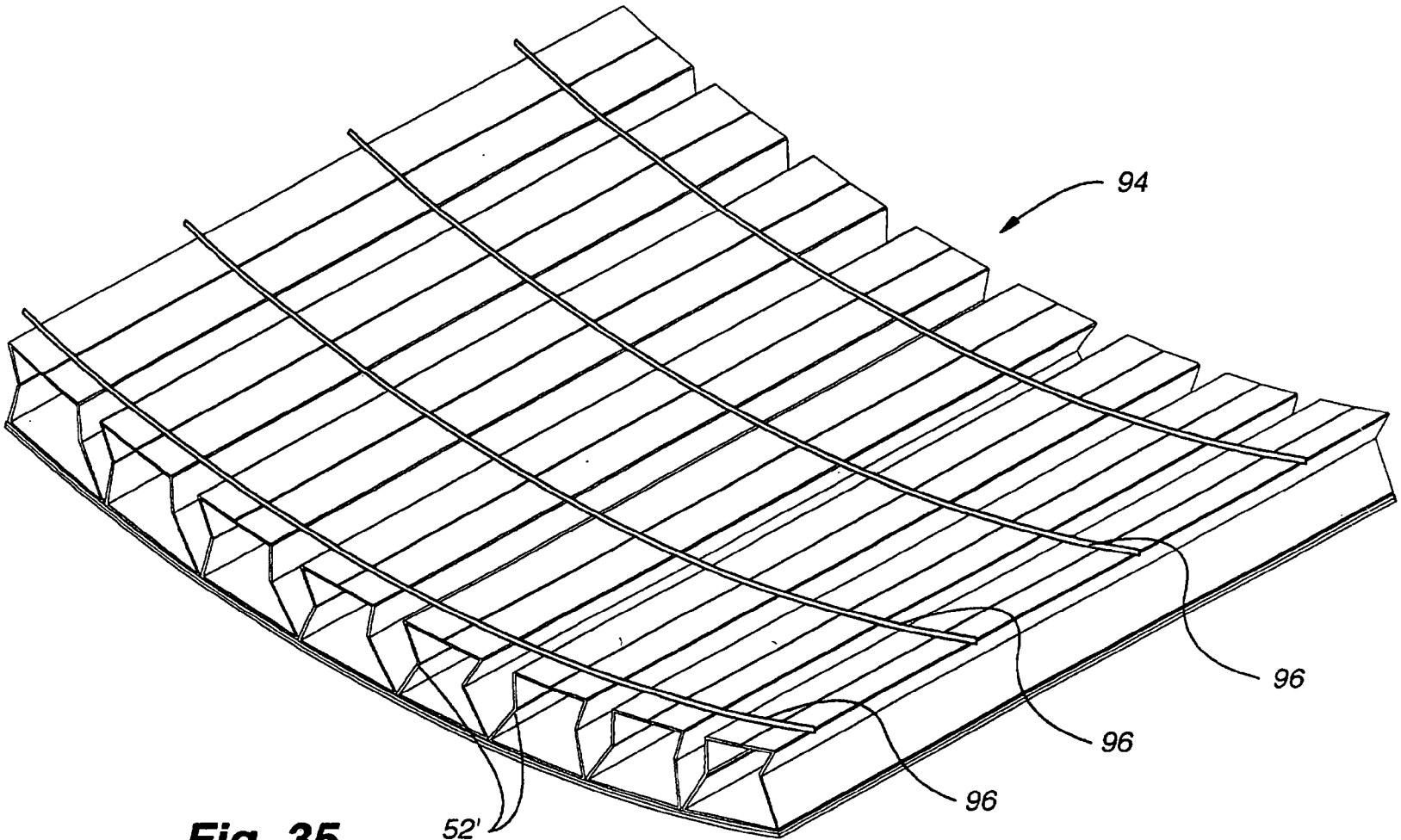
FIG. 35 is an isometric view of the panel shown in FIG. 33 with the panel having been bent or curved so as to be upwardly concave.

FIGS. 33–35 illustrate a second embodiment of a panel 94 wherein the connector sheet 54 has been replaced with a connector in the form of a plurality of elongated flexible but non-extensible strands or fibers 96.

In both FIGS. 12 and 34, the disclosed panels have dividers which have longitudinal fold lines 100 wherein the side partitions fold inwardly when the panel is compressed. The side partitions thereby define upper and lower portions 98*a* and 98*b* which are rectangular but wherein the upper portion 98*a* is of a smaller dimension than the lower portion 98*b*. This may be considered an asymmetric configuration.

Figure 36:
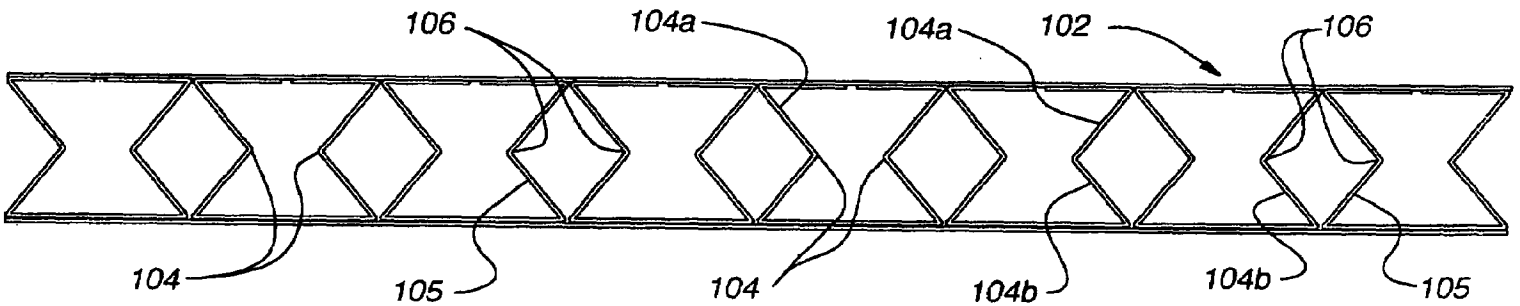
FIG. 36 is an end elevation of a panel formed in accordance with the present disclosure for use with the packaging and shipping method of the present invention and corresponding to the panel shown in FIG. 32.
Figure 37:
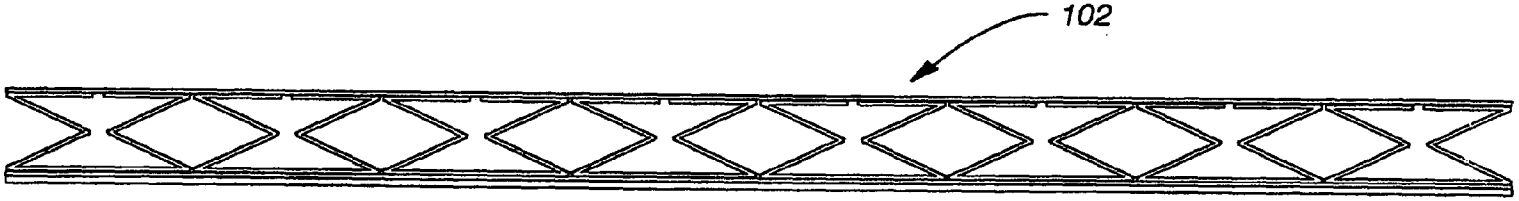
FIG. 37 is an end elevation of the panel shown in FIG. 36 with the panel partially compressed.
Figure 38:
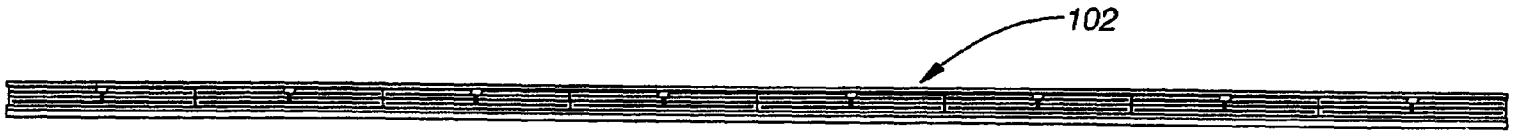
FIG. 38 is an end elevation of the panel shown in FIG. 37 having been fully compressed.
Figure 40:
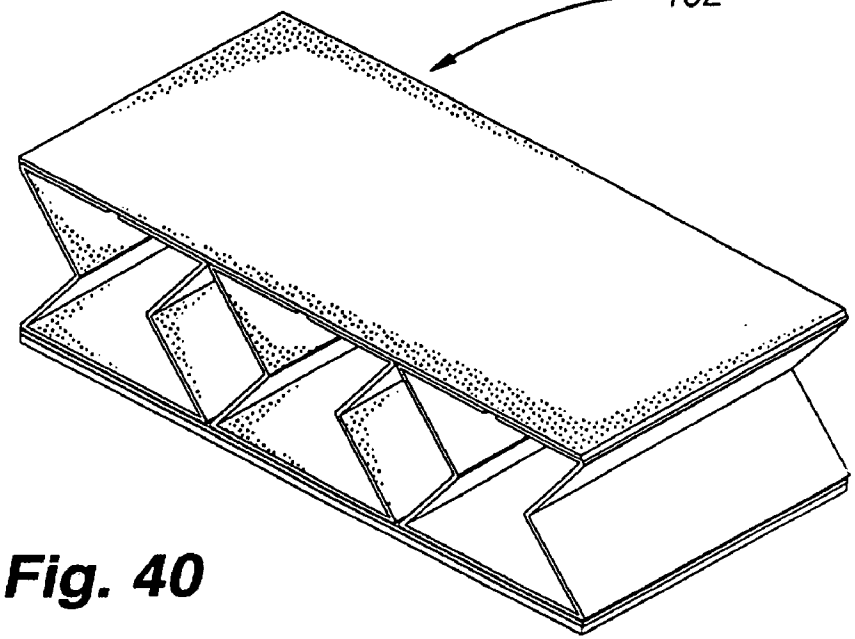
FIG. 40 is an isometric view of a portion of the panel shown in FIG. 36 in a fully expanded condition.
Figure 39:
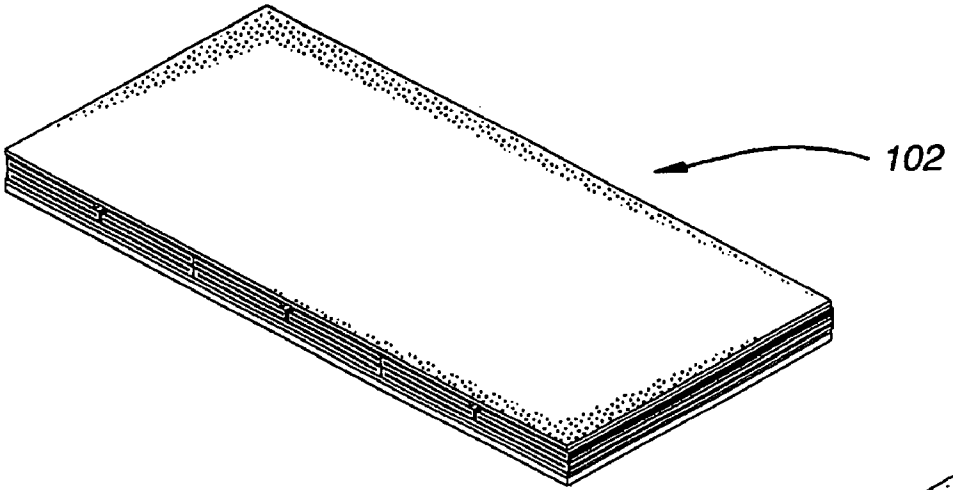
FIG. 39 is an isometric view of the panel shown in FIG. 38 in a fully compressed condition.
Figure 42:
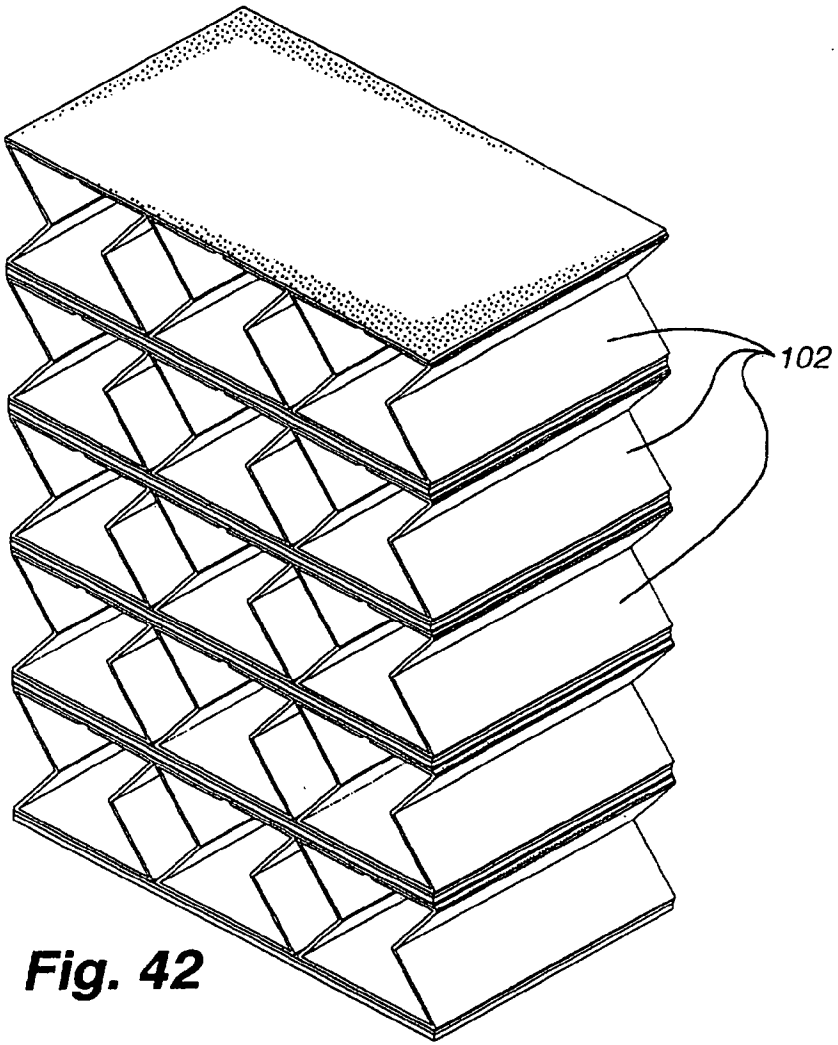
FIG. 42 is an isometric view of a portion of the panels of the type shown in FIG. 36 having been stacked in a fully expanded condition.
Figure 41:
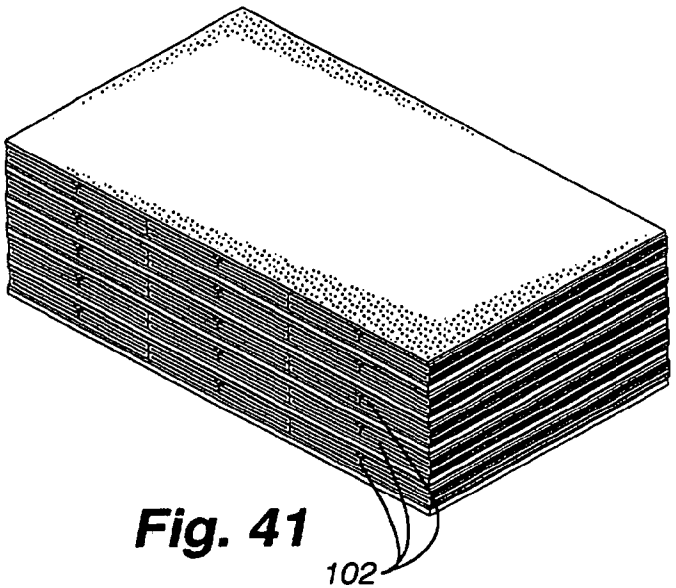
FIG. 41 is an isometric view of a plurality of panels of the type shown in FIG. 36 having been compressed and stacked together.
Figure 43:
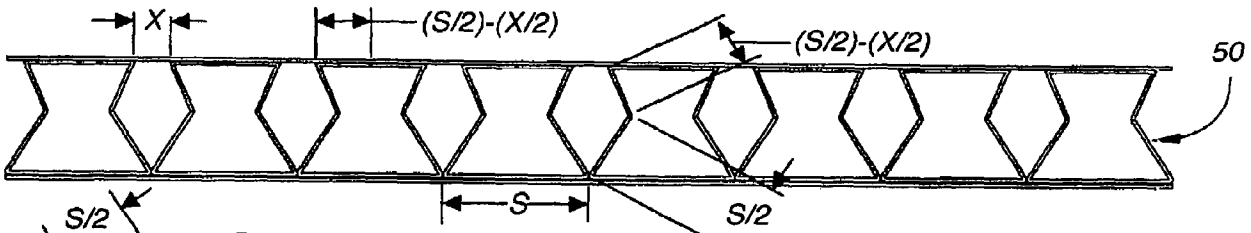
FIG. 43 is a diagrammatic end elevation of a panel with asymmetric dividers illustrating dimensional characteristics thereof.
Figure 44:
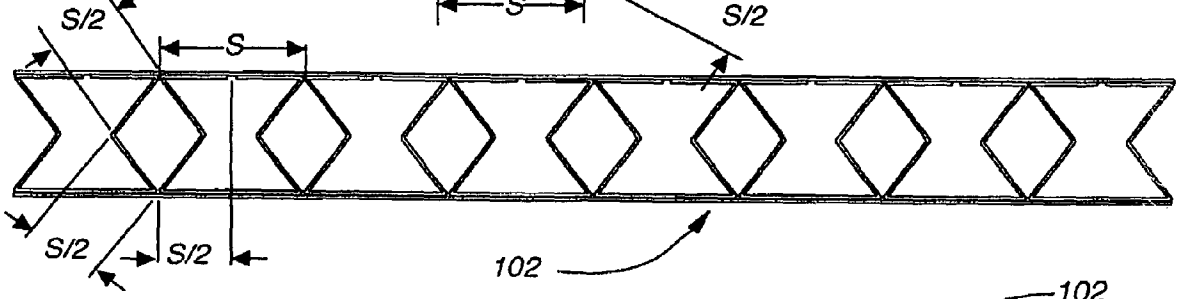
FIG. 44 is a diagrammatic end elevation of a panel with symmetric dividers illustrating dimensional characteristics thereof.
Figure 46:
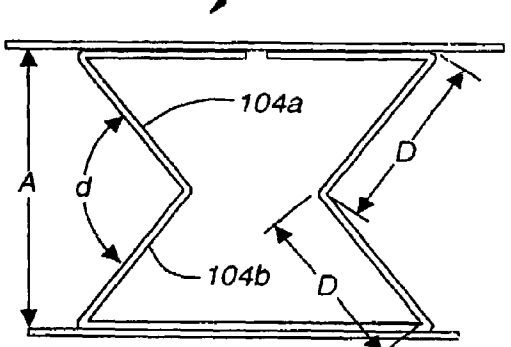
FIG. 46 is an enlarged end elevation of a portion of the panel of FIG. 44 illustrating other dimensional characteristics.
Figure 45:
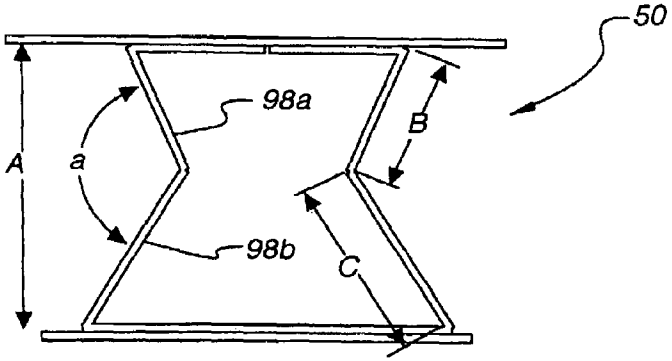
FIG. 45 is an enlarged end elevation of a portion of the panel of FIG. 43 illustrating other dimensional characteristics.
Figure 47:
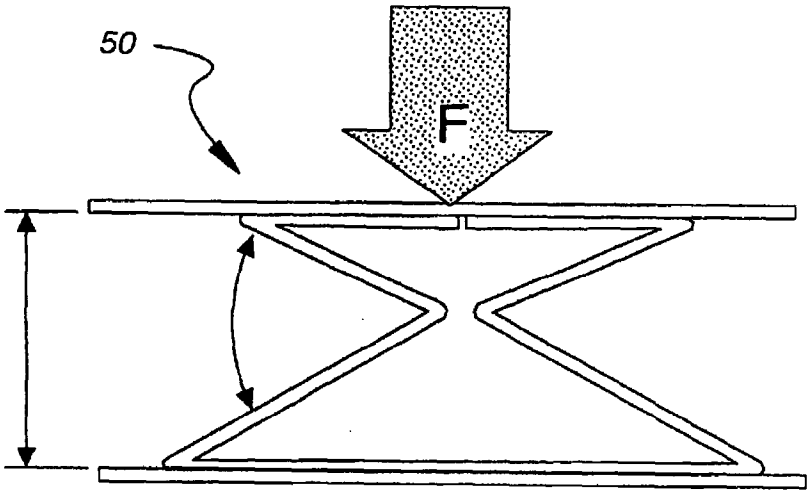
FIG. 47 is an end elevation similar to FIG. 45 showing the panel compressed with a force F.
Figure 48:
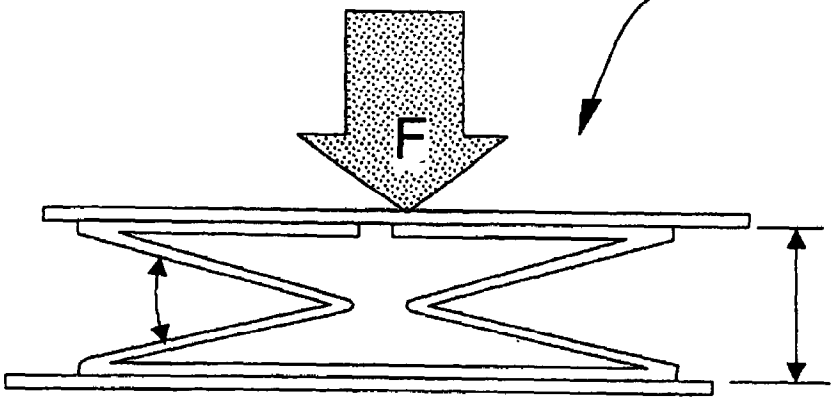
FIG. 48 is an end elevation similar to FIG. 46 showing the panel compressed with a force F.
Figure 50:
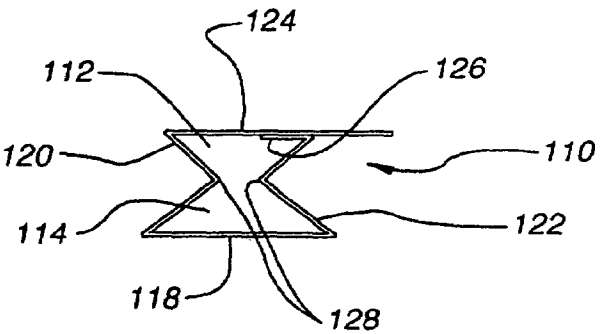
FIG. 50 is an end elevation of the divider shown in FIG. 49.
Figure 52:
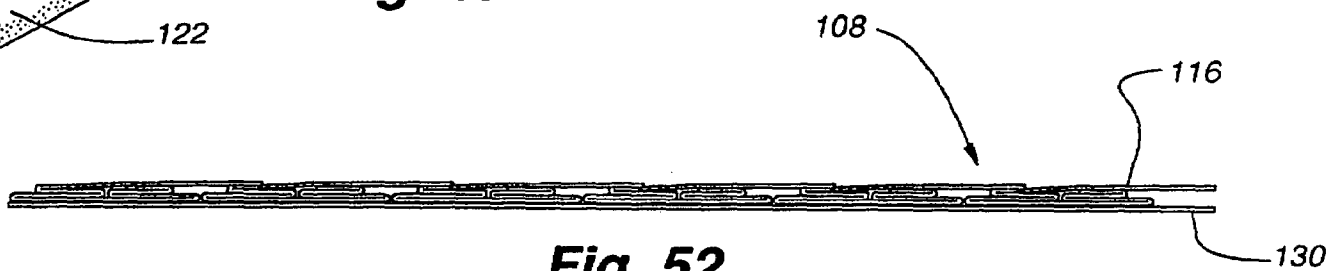
FIG. 52 is a reduced end elevation of the panel shown in FIG. 51 in a compressed form.
Figure 51:
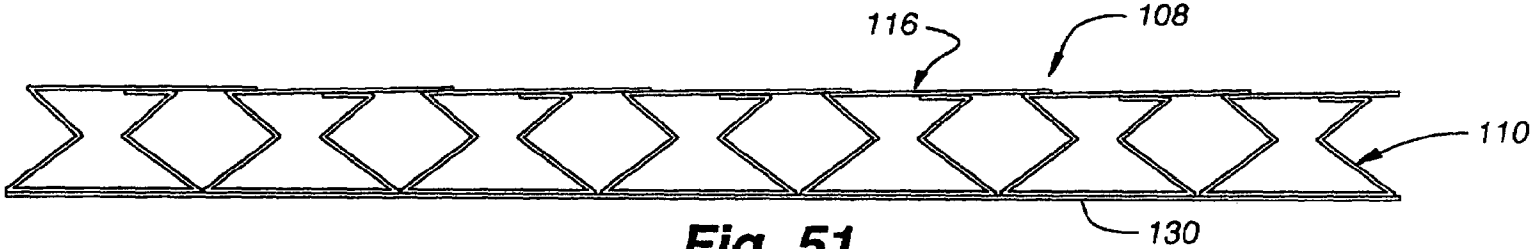
FIG. 51 is an end elevation of a panel including a plurality of the dividers shown in FIG. 49 in an expanded form.
Figure 49:
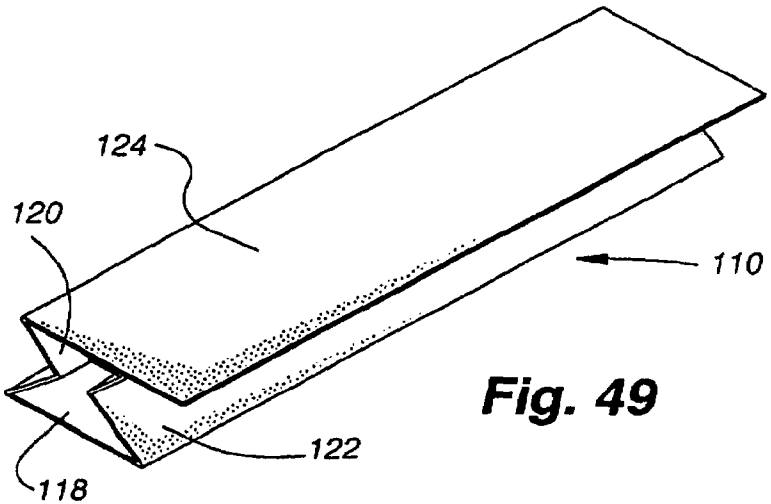
FIG. 49 is an isometric view of another embodiment of a divider for use in the panel of the present disclosure for use with the packaging and shipping method of the present invention.
Figure 53:
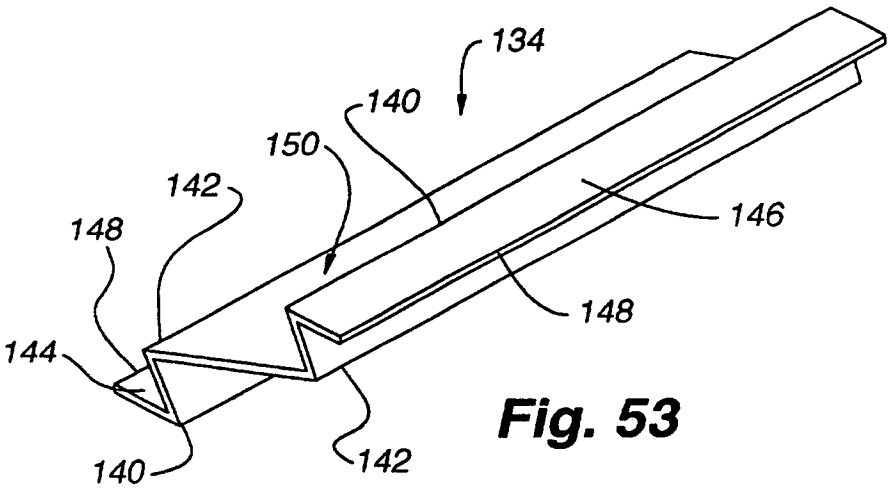
FIG. 53 is an isometric view of still another embodiment of a divider for use in the panel of the present disclosure for use with the packaging and shipping method of the present invention.
Figure 54:
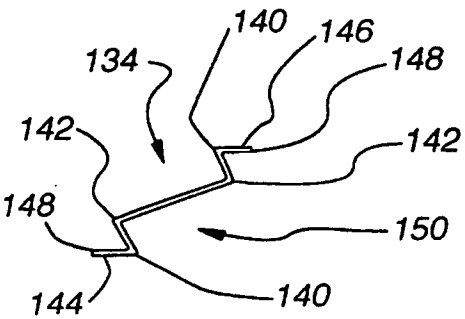
FIG. 54 is an end elevation of the divider shown in FIG. 53.
Figure 56:
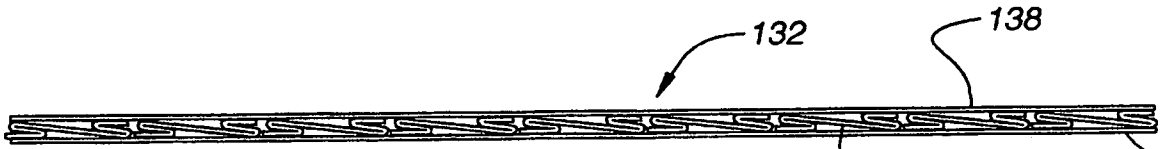
FIG. 56 is a reduced end elevation of the panel of FIG. 55 in a compressed form.
Figure 55:
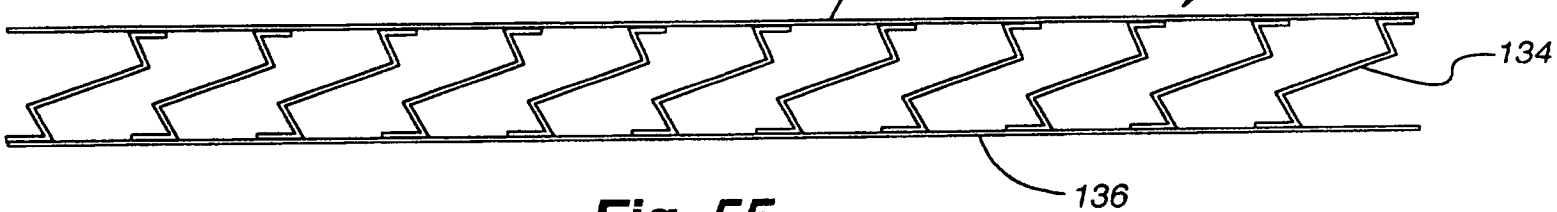
FIG. 55 is an end elevation of a panel formed in accordance with the present disclosure for use with the packaging and shipping method of the present invention and utilizing the divider of FIG. 53 with the panel in an expanded form.
Figure 57:
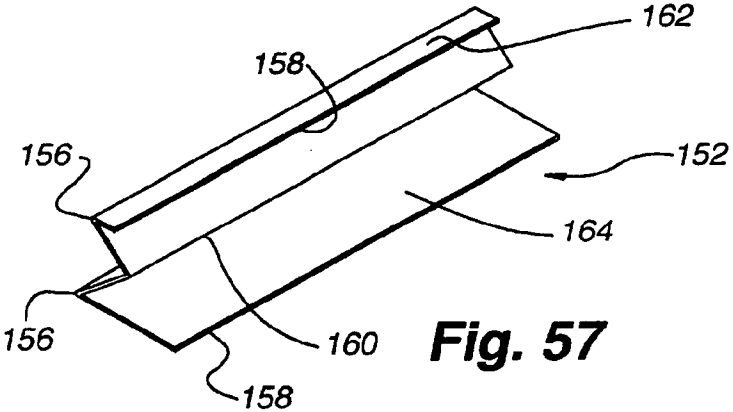
FIG. 57 is an isometric view of still another embodiment for a divider for use in the panel of the present disclosure for use with the packaging and shipping method of the present invention.
Figure 58:
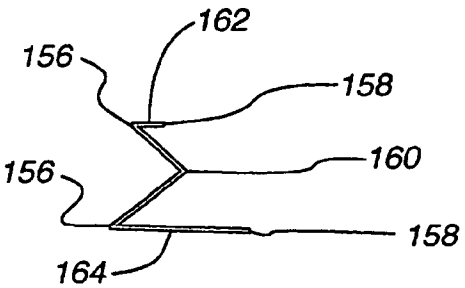
FIG. 58 is an end elevation of the divider shown in FIG. 57.
Figure 60:
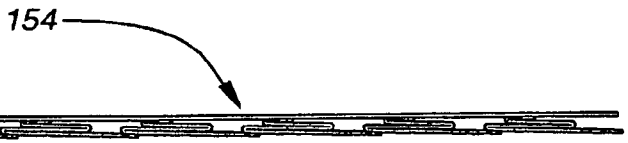
FIG. 60 is a reduced end elevation of the panel shown in FIG. 59 in a compressed form.
Figure 59:
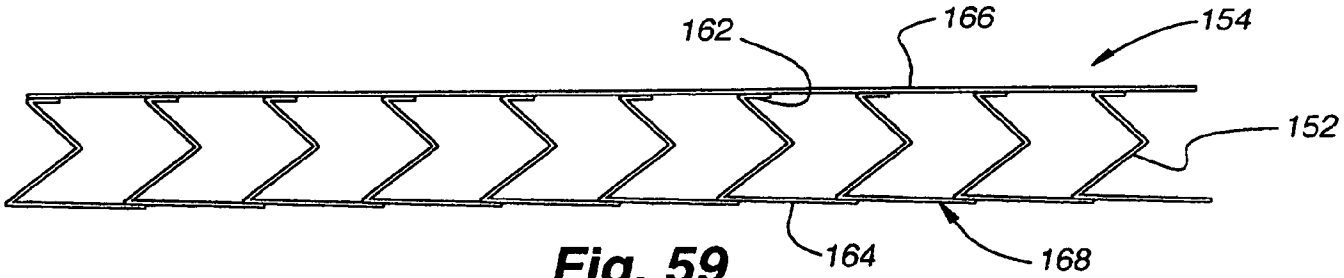
FIG. 59 is an end elevation of a panel utilizing the divider of FIG. 57 with the panel shown in an expanded form.
Figure 61:
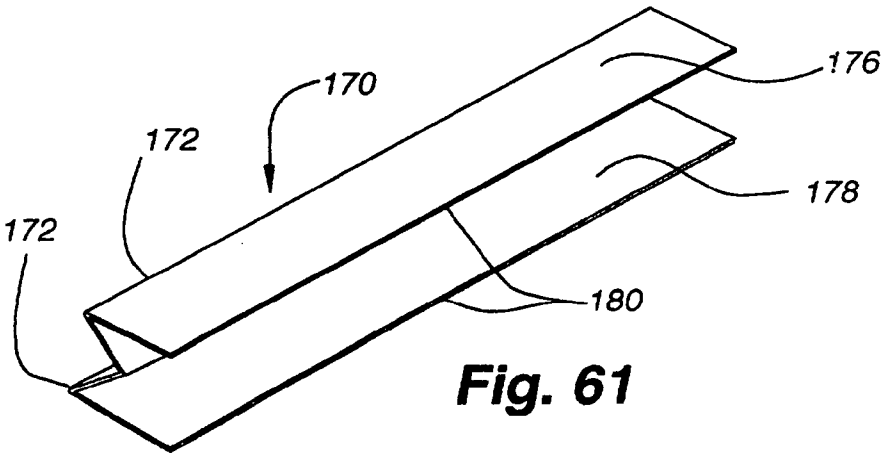
FIG. 61 is an isometric view of still another divider for use in the panel of the present disclosure for use with the packaging and shipping method of the present invention.
Figure 62:
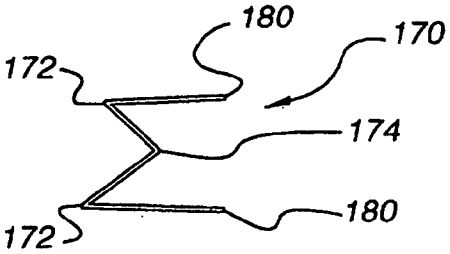
FIG. 62 is an end elevation of the divider shown in FIG. 61.
Figure 64:
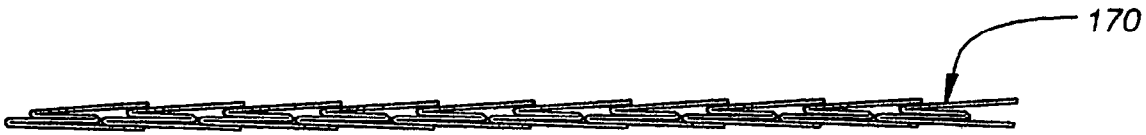
FIG. 64 is a reduced end elevation of the panel shown in FIG. 63 in a compressed form.
Figure 63:
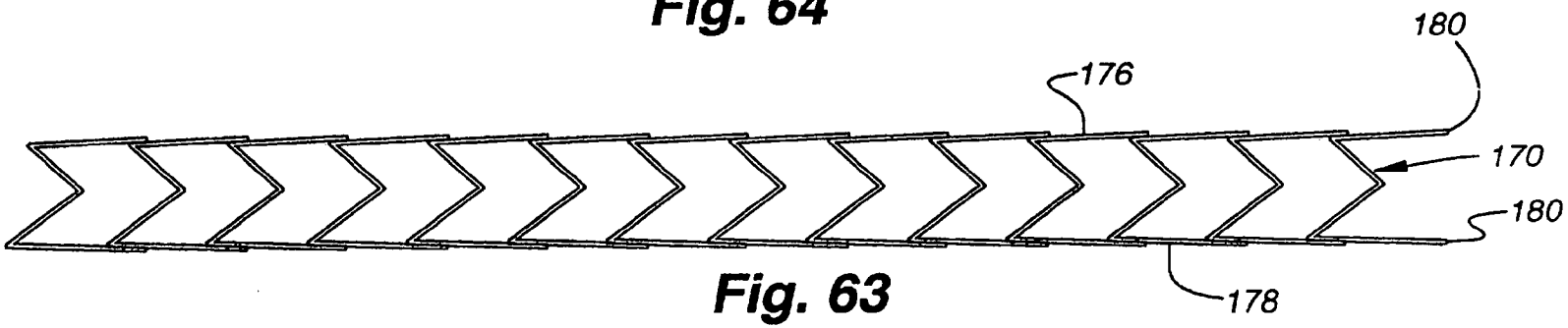
FIG. 63 is an end elevation of a panel utilizing the divider shown in FIG. 61 and with the panel in an expanded form.

FIGS. 36–42 illustrate a third embodiment which is identical to that shown in FIG. 12 except that the partitions 104 in the dividers 105 are symmetric in configuration. In other words, fold lines 106 along the partitions 104 are positioned so that an upper rectangular portion 104*a* of each partition is of equal size to a lower rectangular portion 104*b*. The compressed and expanded forms of the panel 102 shown in FIGS. 36–38 are illustrated isometrically in FIGS. 39 and 40. FIGS. 41 and 42 illustrate the stacking of the compressed panels 102 for shipping.

FIGS. 49–52 illustrate an alternative embodiment wherein the connector sheet is eliminated by use of a divider 110 which is hourglass-shaped.

FIGS. 53–56 illustrate a further alternative embodiment of panel 132 wherein dividers 134 are not cellular in and of themselves but are rather strips of material that have been folded into a zig-zag pattern and secured between an outer sheet and a connector sheet 138 thereby forming a cellular compressible panel.

FIGS. 57–60 illustrate yet another embodiment of divider 152 for use in panel 154. This divider 152 includes a pair of parallel outer crease lines 156 with folds in the same direction therein spaced inwardly from the side edges 158 of a strip of material from which the divider is formed and a third intermediate crease line 160 between the parallel outer crease lines. An upper marginal zone 162 is defined between one edge of the strip of material and one of the outer crease lines and a second much larger lower marginal zone is defined along the bottom of the divider between the associated edge of the strip of material and the adjacent crease line. The overlapping lower marginal zones are secured to each other thereby forming an integrated segmented outer sheet 168 formed from the plurality of lower marginal zones of the respective dividers.

A similar embodiment 170 of a divider is shown in FIGS. 61–64 where a strip of material is provided with a pair of outer crease lines 172 and an intermediate crease line 174 therebetween, with upper and lower marginal zones 176 and 178 being defined between the edges 180 of the strip and the outer crease lines 172. The folds at the outer crease lines 172 are in an opposite direction to the fold along the intermediate crease line 174 so that the outer and lower marginal zones both project horizontally to the right, as viewed in FIG. 62. Both of the horizontal zones extend horizontally beyond the intermediate crease line 174 and are adapted to overlap the upper and lower marginal zones of adjacent dividers to the right so that they can be secured thereto in any suitable manner to form the panel shown expanded in FIG. 63 and compressed in FIG. 64.

Figure 68:
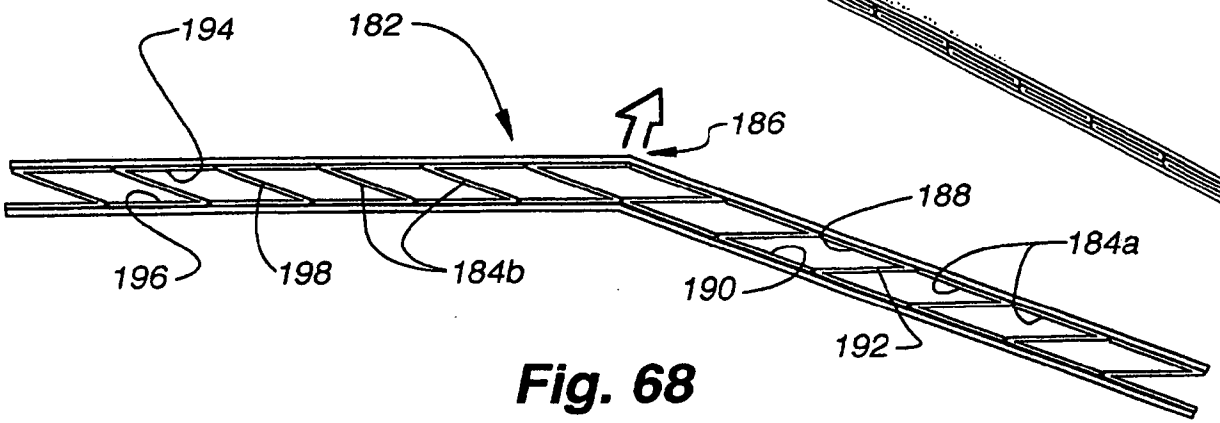
FIG. 68 is an end elevation of a further embodiment of the present disclosure for use with the packaging and shipping method of the present invention in which the panel can be bent at a right angle.
Figure 70:
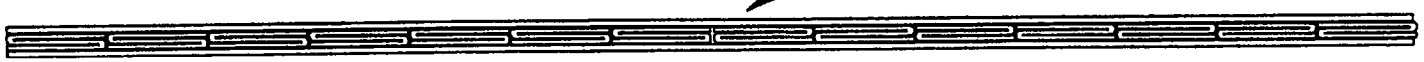
FIG. 70 is a side elevation of the panel shown in FIG. 69.
Figure 73:
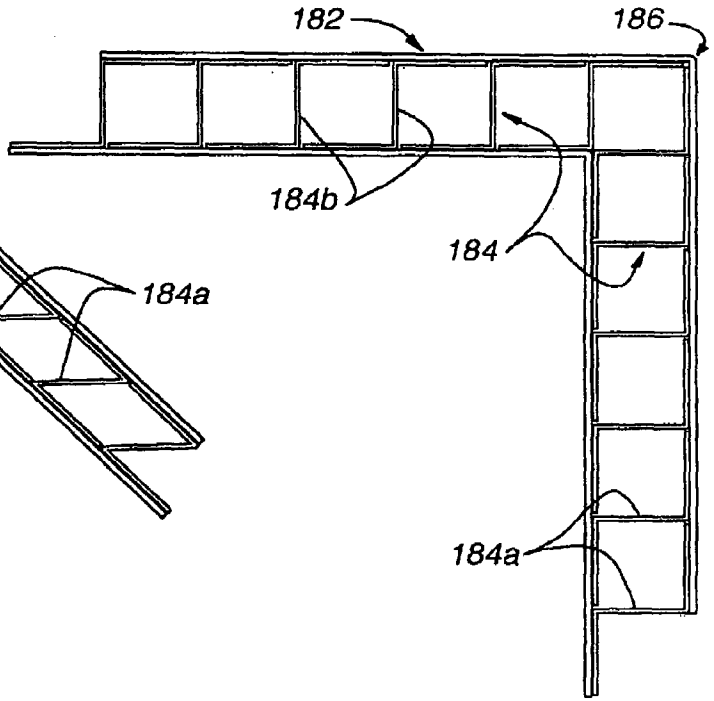
FIG. 73 is an end elevation of the panel as shown in FIG. 72.
Figure 71:
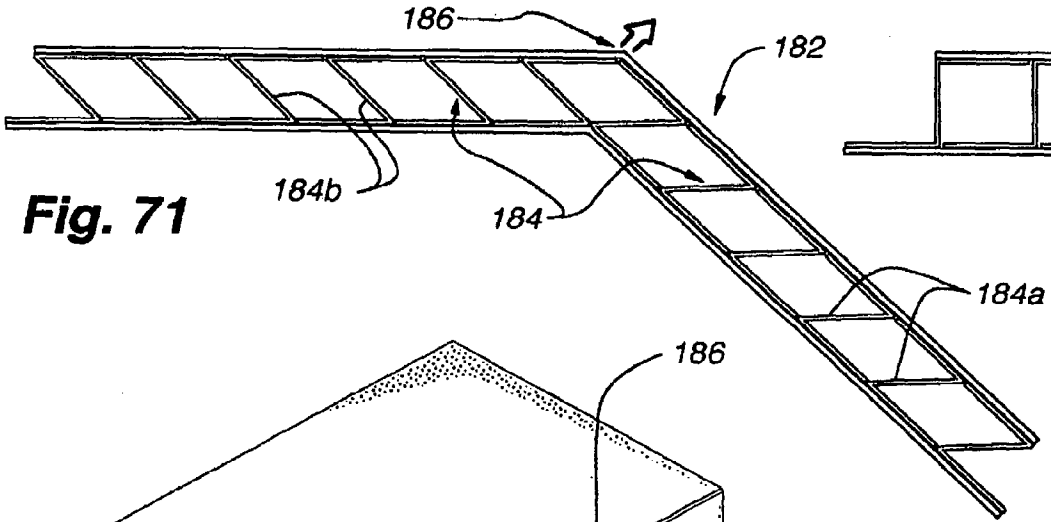
FIG. 71 is an end elevation similar to FIG. 68 with the panel slightly further expanded.
Figure 72:
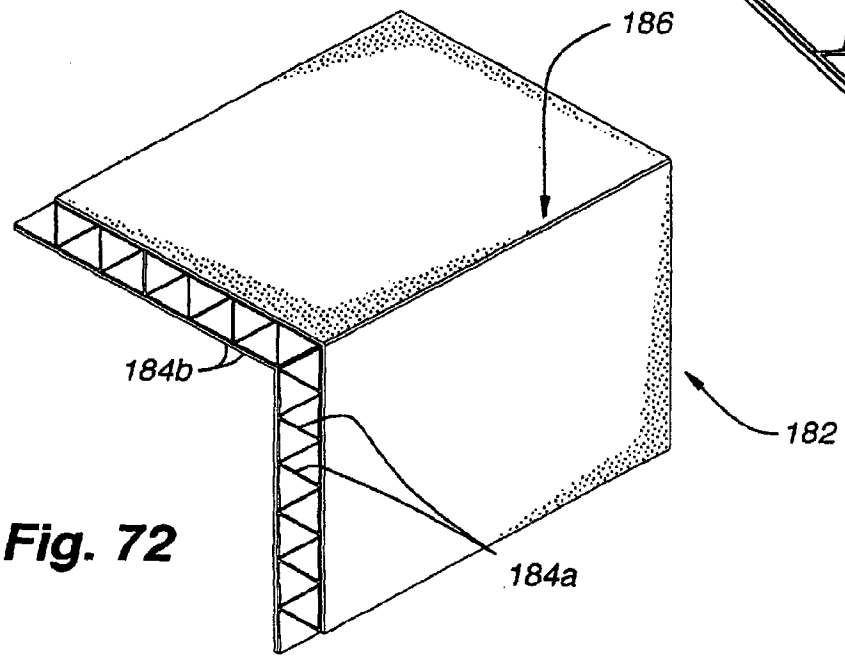
FIG. 72 is an isometric view of the panel of FIG. 68 having been bent along a right angle and with the panel fully expanded.
Figure 74:
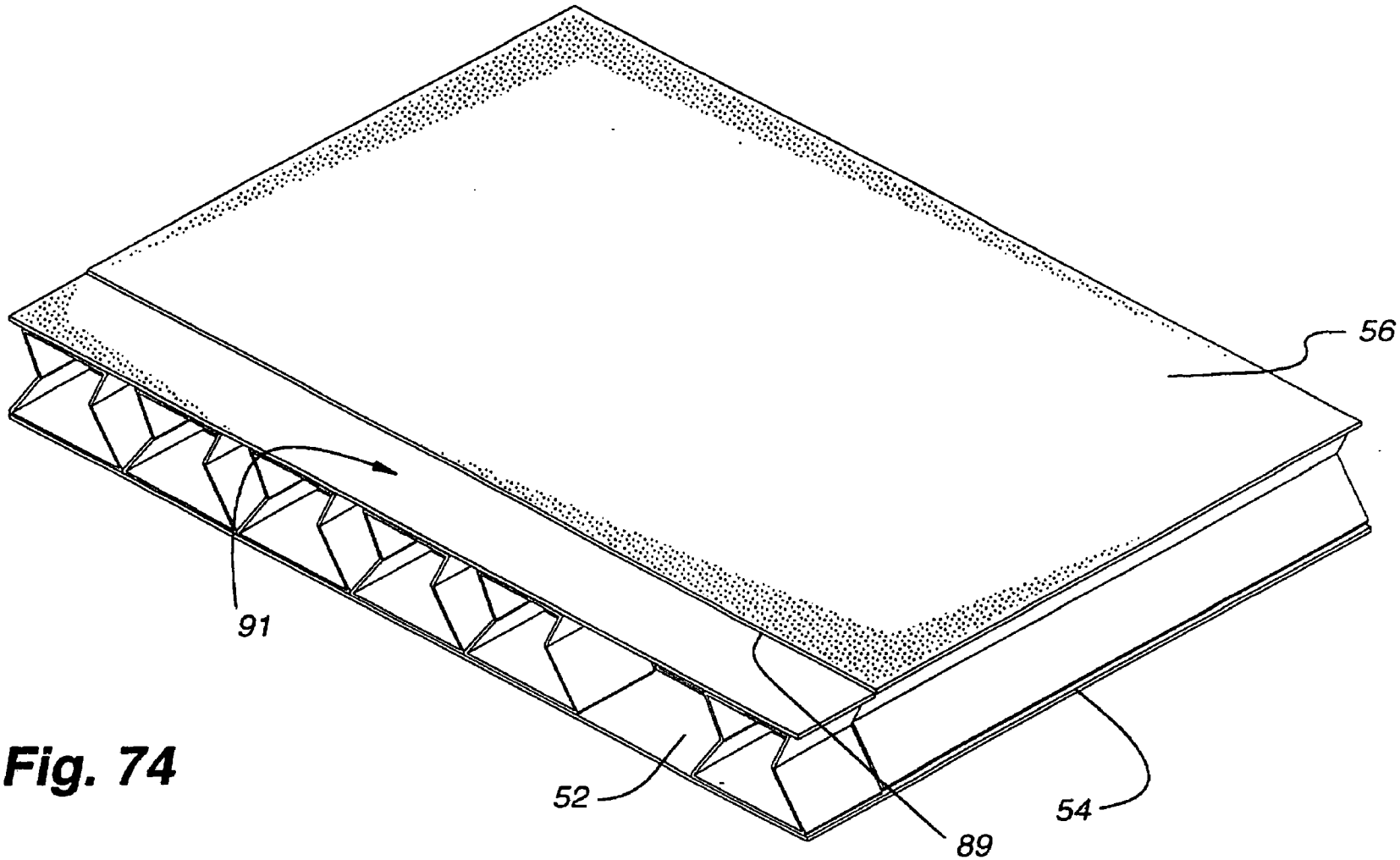
FIG. 74 is an fragmentary isometric view of an end of a panel with a segment of the panel having been partially cut.

A further embodiment of a panel 182 is disclosed in FIGS. 68–73 wherein the panel has an outer sheet 54, a connector sheet 56 and a plurality of dividers 184 extending therebetween. As shown in FIGS. 68 and 71, the dividers 184*a* in a part of the panel are of Z-shaped cross-section while the dividers 184*b* in the other part of the panel are of reverse Z-shaped cross-section. At the location 186 at which the direction of the dividers changes, the panel can be bent at a right angle as seen in FIGS. 72 and 73 so that the panel can, for example, follow the right-angled contours of building components on which it is mounted.

As shown in FIGS. 68 and 71, the dividers 184*a* in the right-hand portion of the panel are Z-shaped in cross-section so as to define an upper horizontal leg 188 that extends to the left, a lower horizontal leg 190 that extends to the right and a diagonal connecting leg 192 that connects the right edge of the upper leg to the left edge of the lower leg. The Z-shaped dividers 184*a* are formed similarly to those described previously by placing crease lines in strips of material from which the dividers are made and then folding the strips of material along the crease lines.

As shown in FIGS. 68 and 71–73, at the location 186 where the direction of the dividers changes, (in the illustrated panel, near its center) the panel can be folded at a right angle. The panel can then be fully expanded as shown in FIGS. 72 and 73 so that the legs of the dividers are perpendicular to each other thereby forming rectangular cells.

Figure 69:
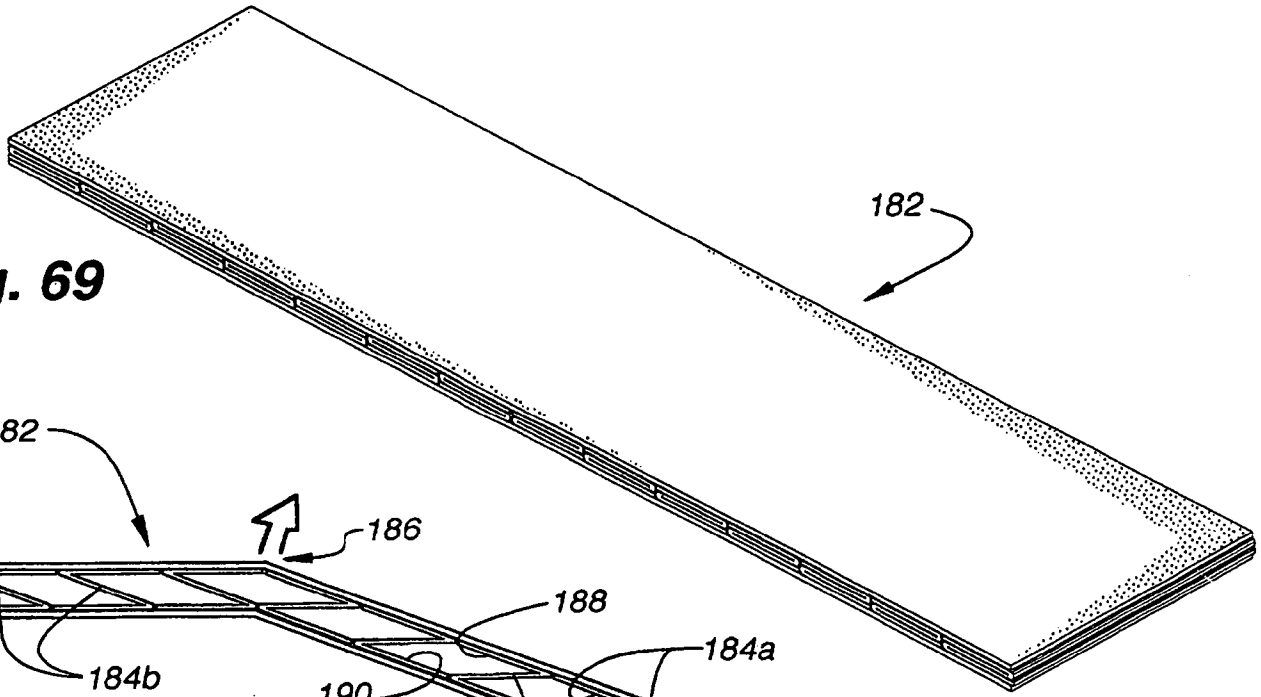
FIG. 69 is an isometric view of a panel formed as in FIG. 68 with the panel in a fully compressed condition.

As shown in FIGS. 68 and 69, it will be appreciated that the panel can also be compressed as with the earlier described embodiments of panels made in accordance with the present disclosure for use with the packaging and shipping method of the present invention.

Figure 9:
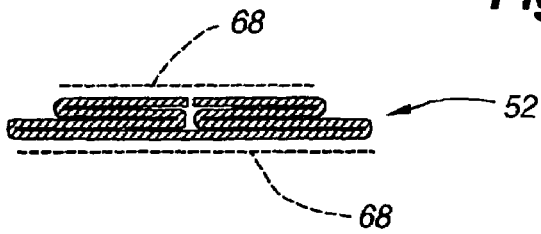
FIG. 9 is a front elevation similar to FIG. 8 with a layer of adhesive shown in dashed lines positioned above and below the divider.
Figure 99:
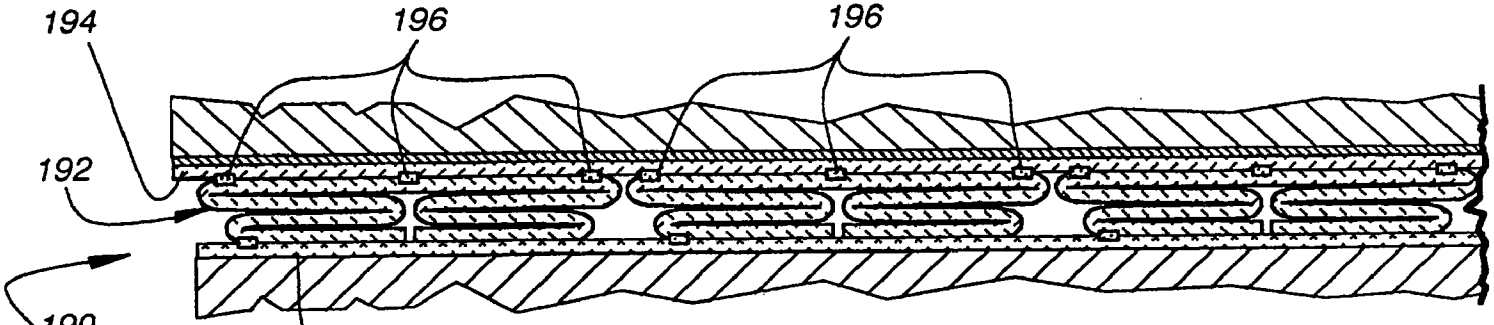
FIG. 99 is a fragmentary section taken through an alternative embodiment of a compressed panel showing a unique system for gluing the cellular structures to the outer and cover sheets.
Figure 100:
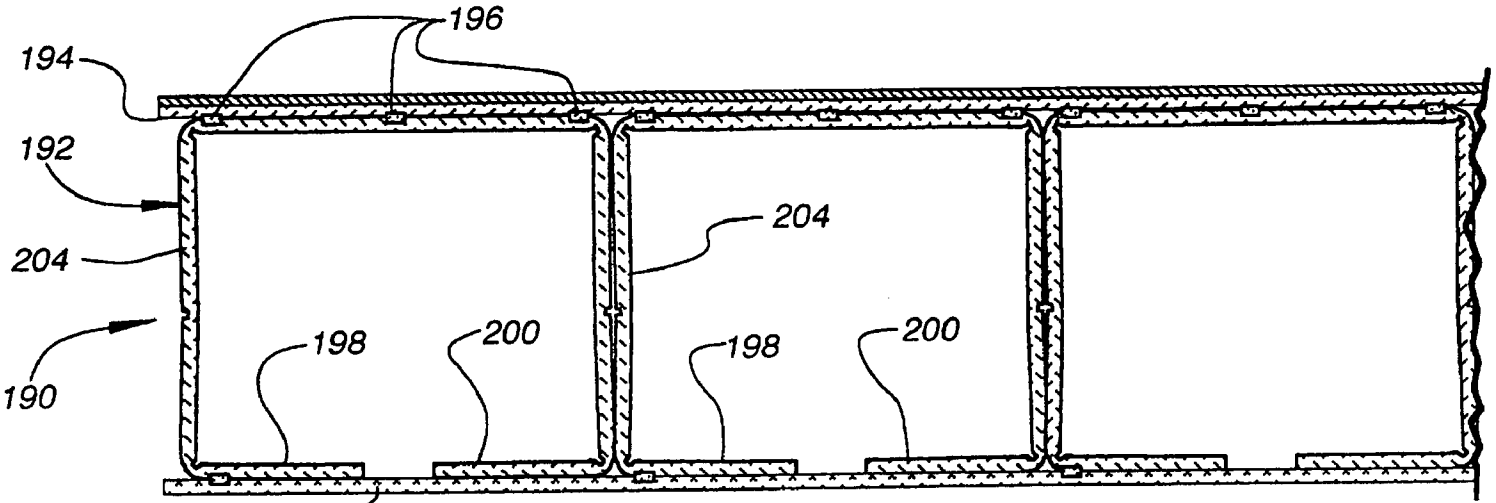
FIG. 100 is a fragmentary section similar to FIG. 99 with the panel fully expanded.
Figure 104:
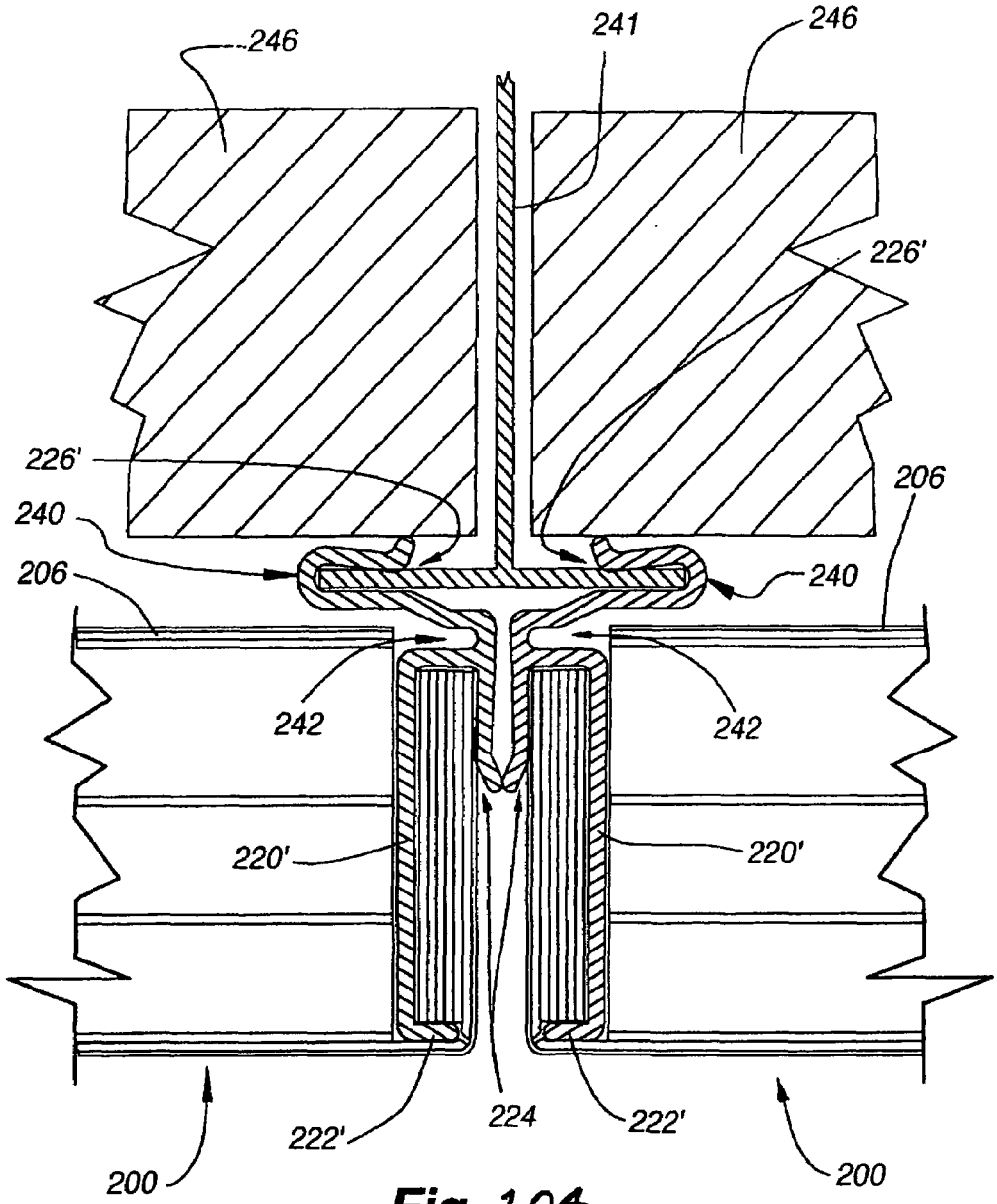
FIG. 104 is a fragmentary vertical section showing a panel with a clip of the type shown in FIG. 103 supporting adjacent panels from an inverted T-grid support system.

In still a further embodiment 190 of the panel of the present disclosure for use with the packaging and shipping method of the present invention shown in FIGS. 99 and 100, the dividers 192 are of the configuration illustrated for example in FIGS. 7–9 even though they have been inverted so that the bottom of the divider is shown on the top and secured to the overlying outer sheet 194 along three parallel glue lines 196. The opposite side of the divider which is open and defined by two flaps 198 and 200 has one of the flaps 198 secured to the connector sheet 202 while the other flap 200 is unsecured. The panel 190 is shown in a compressed condition in FIG. 99 and an expanded position in FIG. 100. In the compressed condition, it will be seen that the connector sheet 202 is shifted slightly to the right relative to the outer sheet 194. When the panel is allowed to fully expand as shown in FIG. 100, the left sidewall 204 of each cell folds out into a vertical orientation as the material from which the cell is made biases the sheet toward a flat orientation and in doing so, the connector sheet 202 is pulled or shifted to the left so that its edges become aligned with the edge of the outer sheet. The movement of the connector sheet to the left is caused by the unfolding of the sidewalls of the divider. The connection of the left flap 198 to the connector sheet 202 pulls the connector sheet to the left upon expansion of the cell. On the other hand, as the right side of the dividers unfolds and assumes a vertical orientation, the bottom flap 200 associated therewith is allowed to slide relative to the connector sheet 202 so that the flaps become more separated than they are in the compressed condition of FIG. 99. The right sidewall of one divider is then folded into contiguous relationship with the left sidewall of an adjacent divider so that the sidewalls of the dividers reinforce each other and become somewhat rigid to rigidify the panel so that it cannot be easily compressed.

Figure 75:
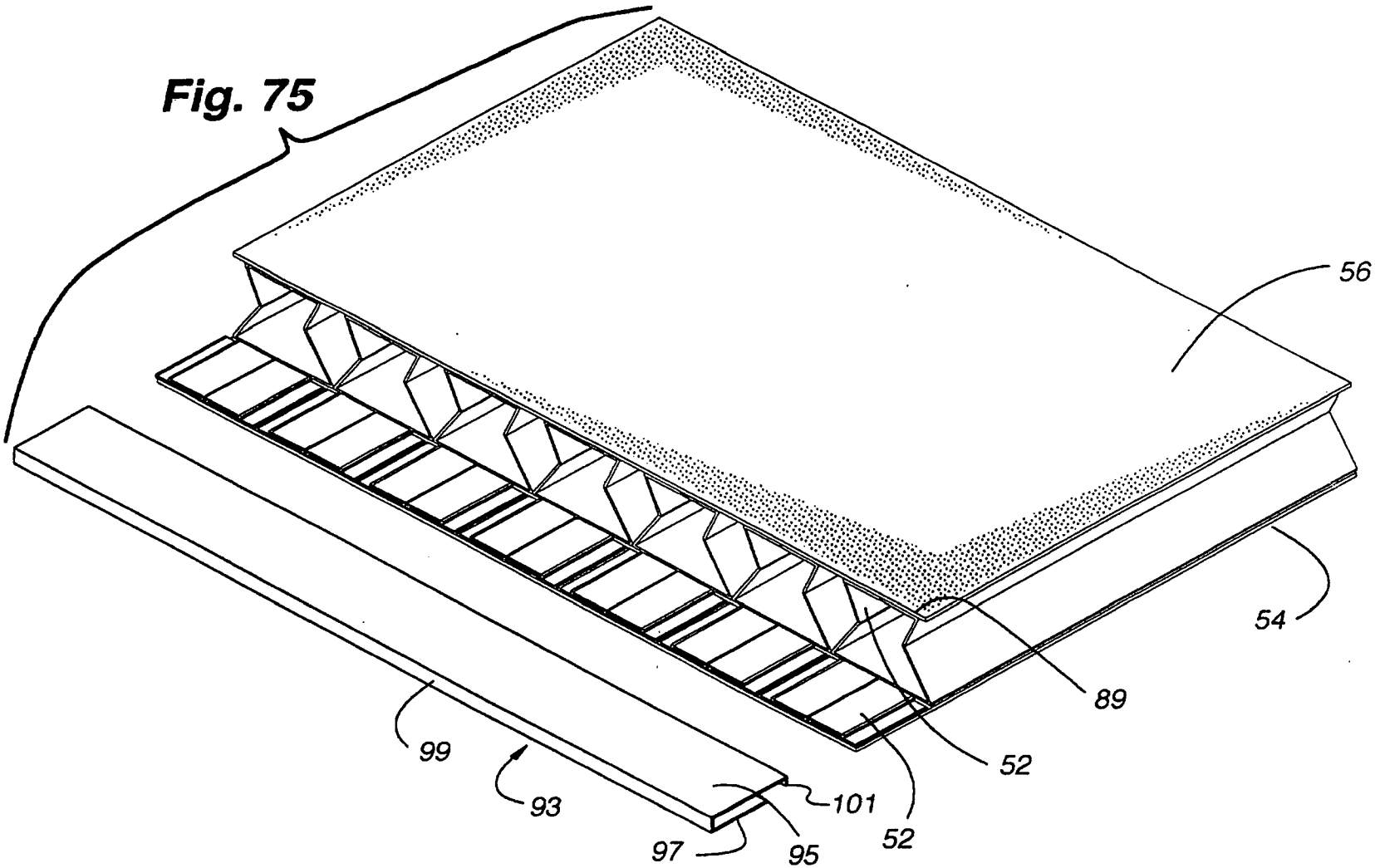
FIG. 75 is a fragmentary isometric similar to FIG. 74 with the partially cut segment of the panel having been compressed and positioned for receipt of an elongated clip.
Figure 77:
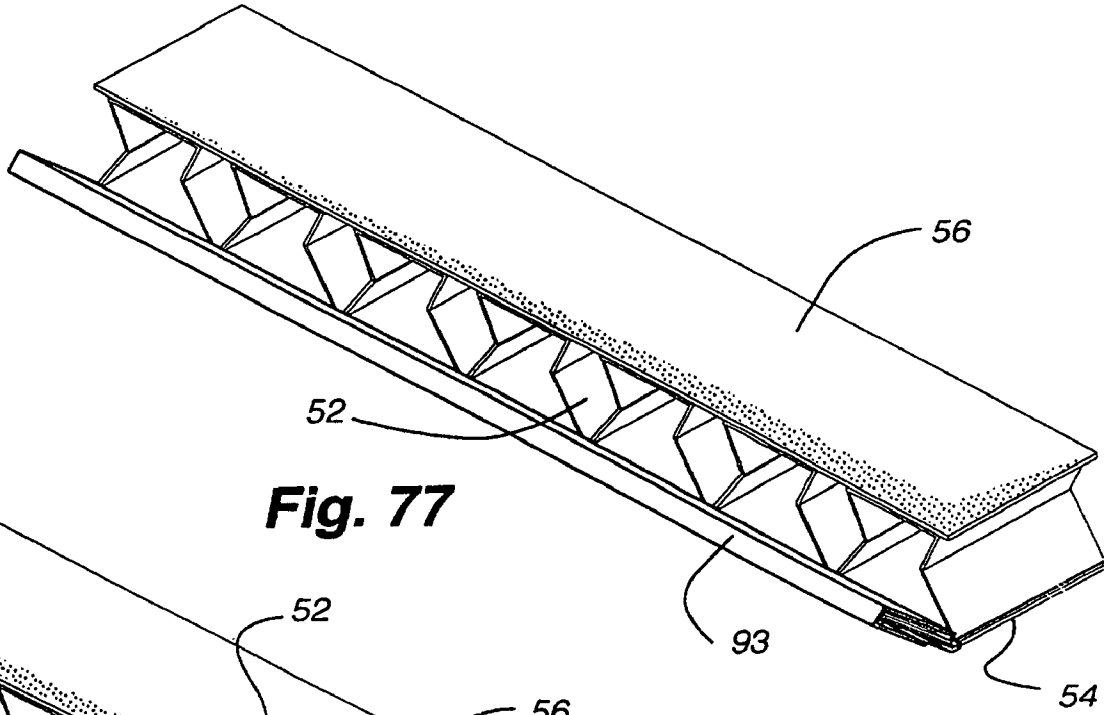
FIG. 77 is a fragmentary isometric similar to FIG. 76 wherein the clip mounted on the compressed segment of the panel is being folded upwardly.
Figure 76:
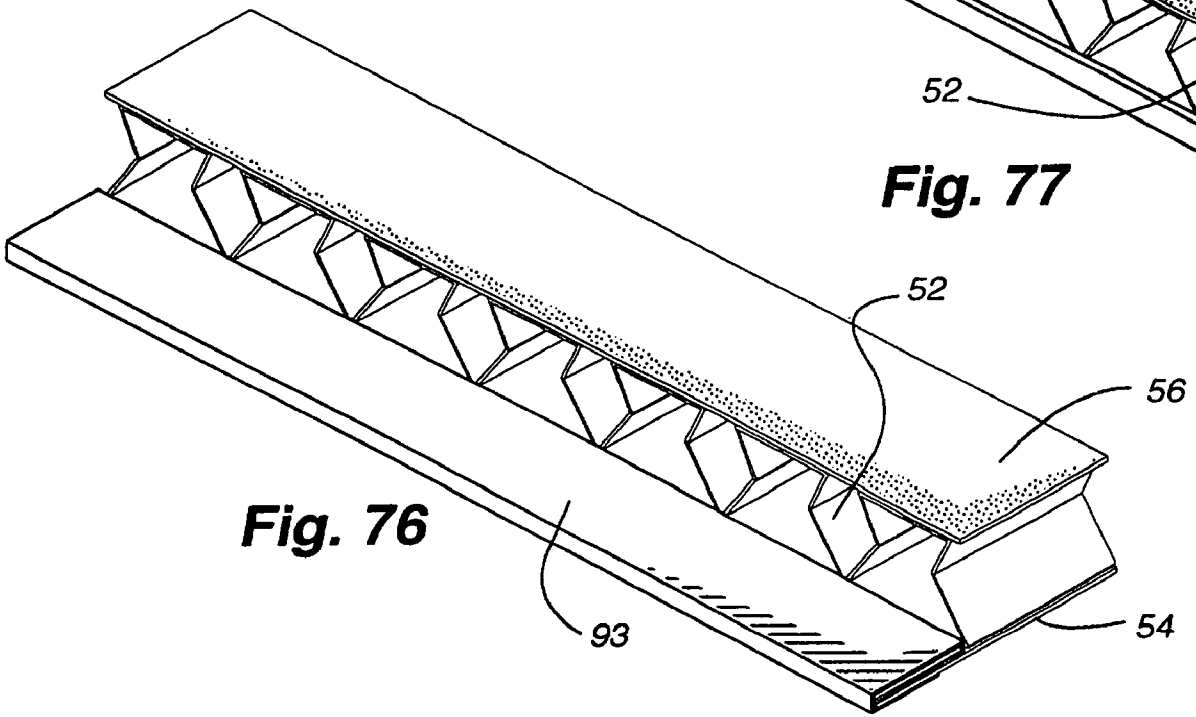
FIG. 76 is a fragmentary isometric similar to FIGS. 74 and 75 showing the clip having been mounted on the compressed segment of the panel.
Figure 79:
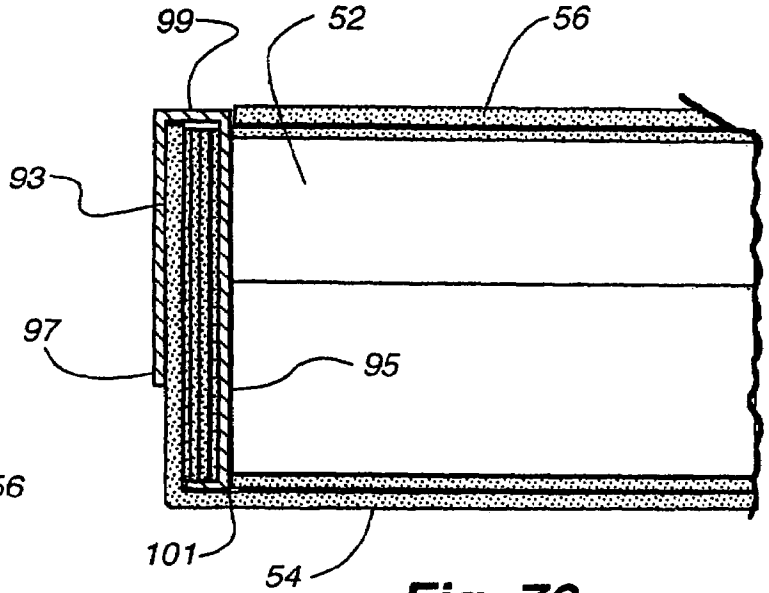
FIG. 79 is an enlarged fragmentary section taken along line 79—79 of FIG. 78.
Figure 78:
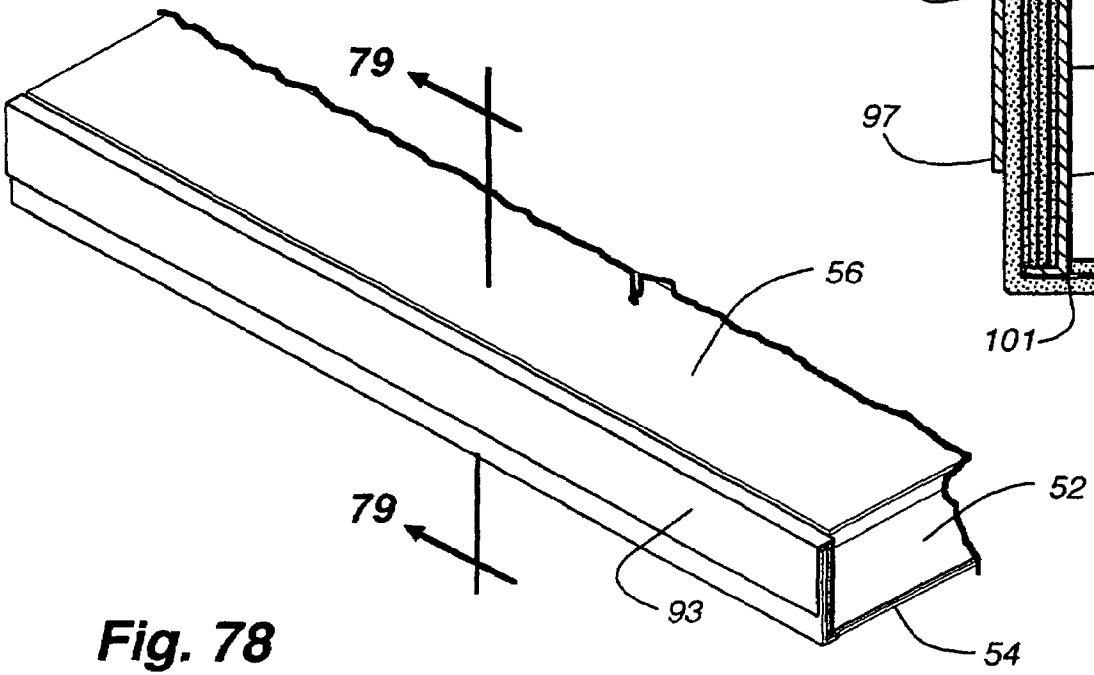
FIG. 78 is a fragmentary isometric similar to FIG. 77 wherein the clip mounted on the compressed segment of the panel has been folded 900 into abutment with the new end of the panel.
Figure 80:
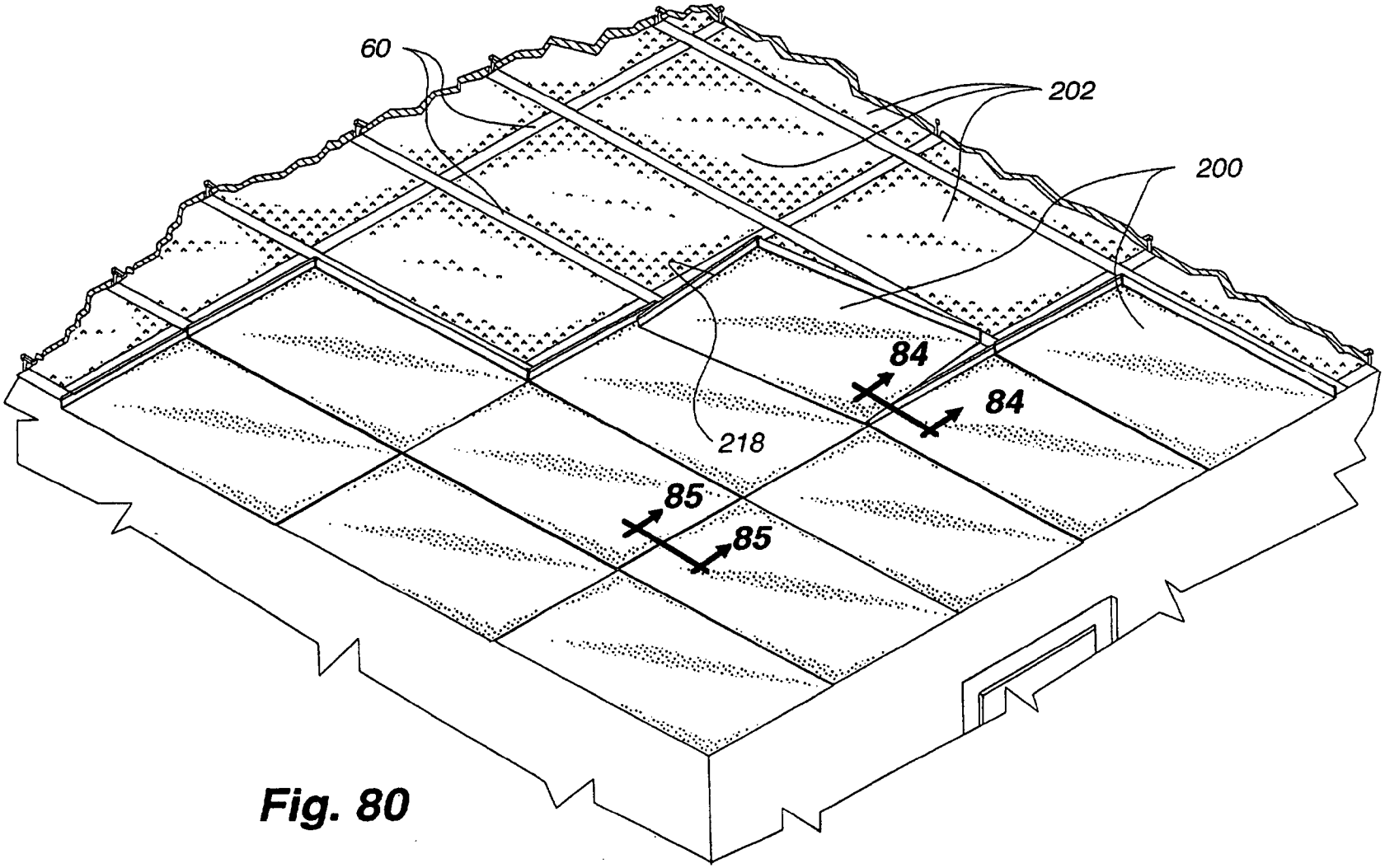
FIG. 80 is a fragmentary isometric view of an alternative arrangement of a ceiling system wherein panels are suspended from rather than supported by a supporting gridwork.

The compressible panel used is the method packaging and shipping of the present invention is also amenable to rigidification in a cross-direction in a manner illustrated in FIGS. 74–79. A segment of the panel near an end thereof can be partially cut at 89 by cutting through the connector sheet 56 and the dividers 52 (in a direction transverse to the length of the dividers) but not severing the outer sheet 54. This cut forms a small band 91 of material, which can be independently compressed as illustrated in FIG. 75 to receive a rigidifying clip 93. The rigidifying clip in the disclosed embodiment is of substantially J-shaped cross-section having a long side 95, a spaced parallel short side 97, a connecting wall 99 interconnecting corresponding edges of the long and short sides and a lip 101 depending from the long side along the opposite edge from the connecting wall 99. The clip is mounted on the compressed band of material so as to retain the material in a compressed state. The clip and compressed material can then be folded upwardly as shown in FIGS. 77 and 78 to form a rigidification along the end of the panel. The rigidified band of material can be adhesively secured in position after it has been folded upwardly as illustrated in FIGS. 78 and 79 if desired.

Figure 84:
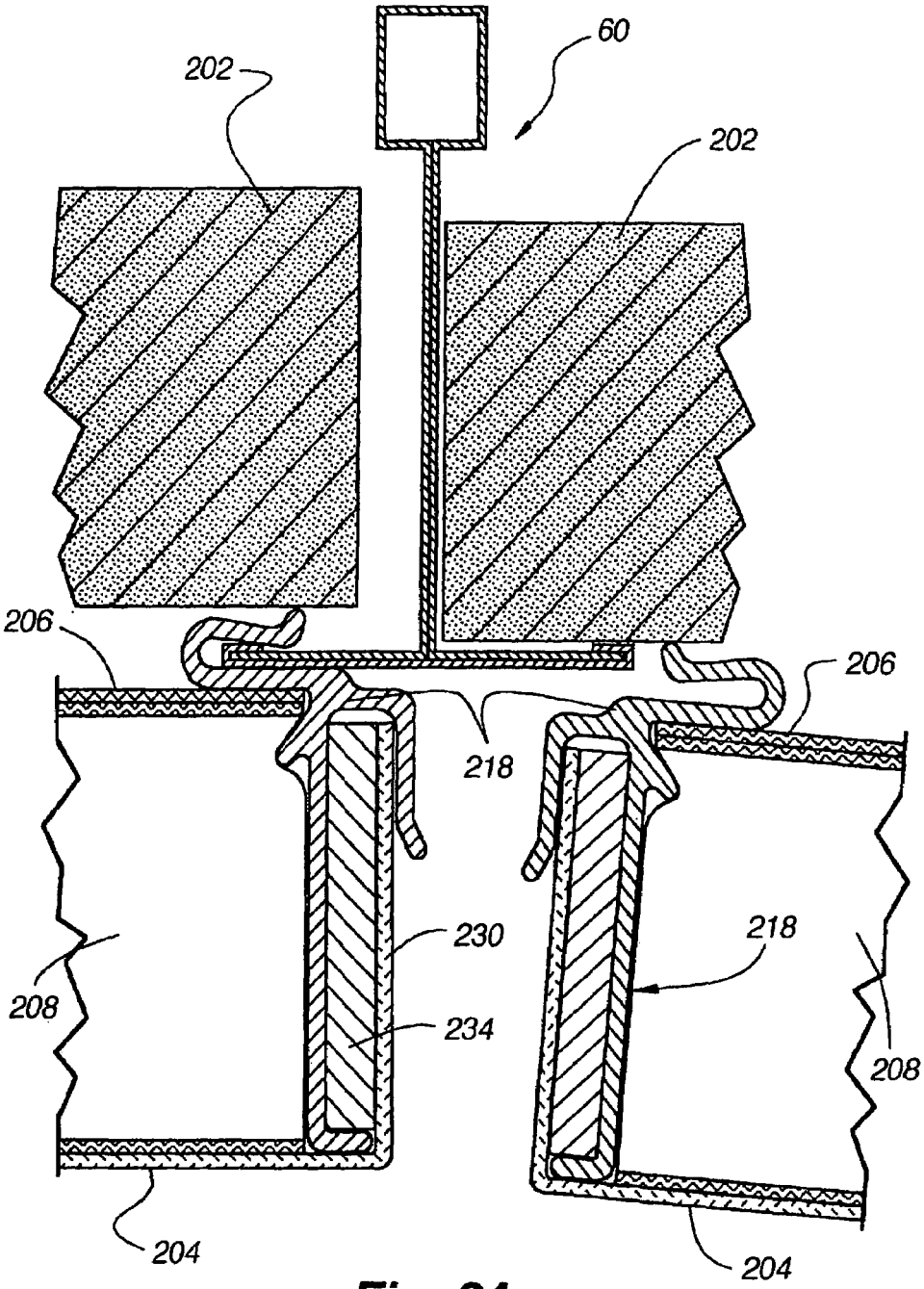
FIG. 84 is an enlarged fragmentary longitudinal section taken along line 84—84 of FIG. 80.
Figure 85:
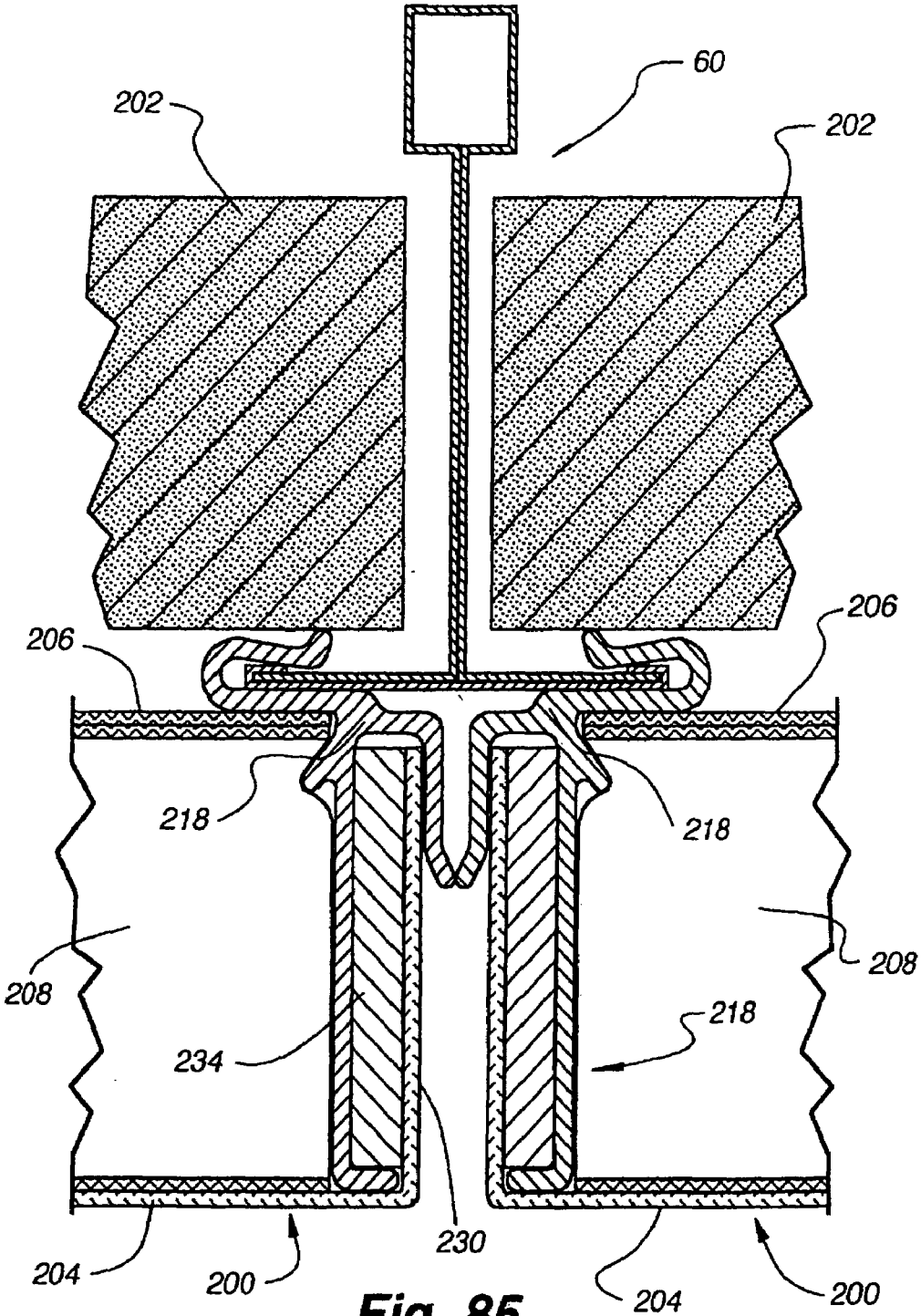
FIG. 85 is an enlarged fragmentary sectional taken along line 85—85 of FIG. 80.
Figure 86:
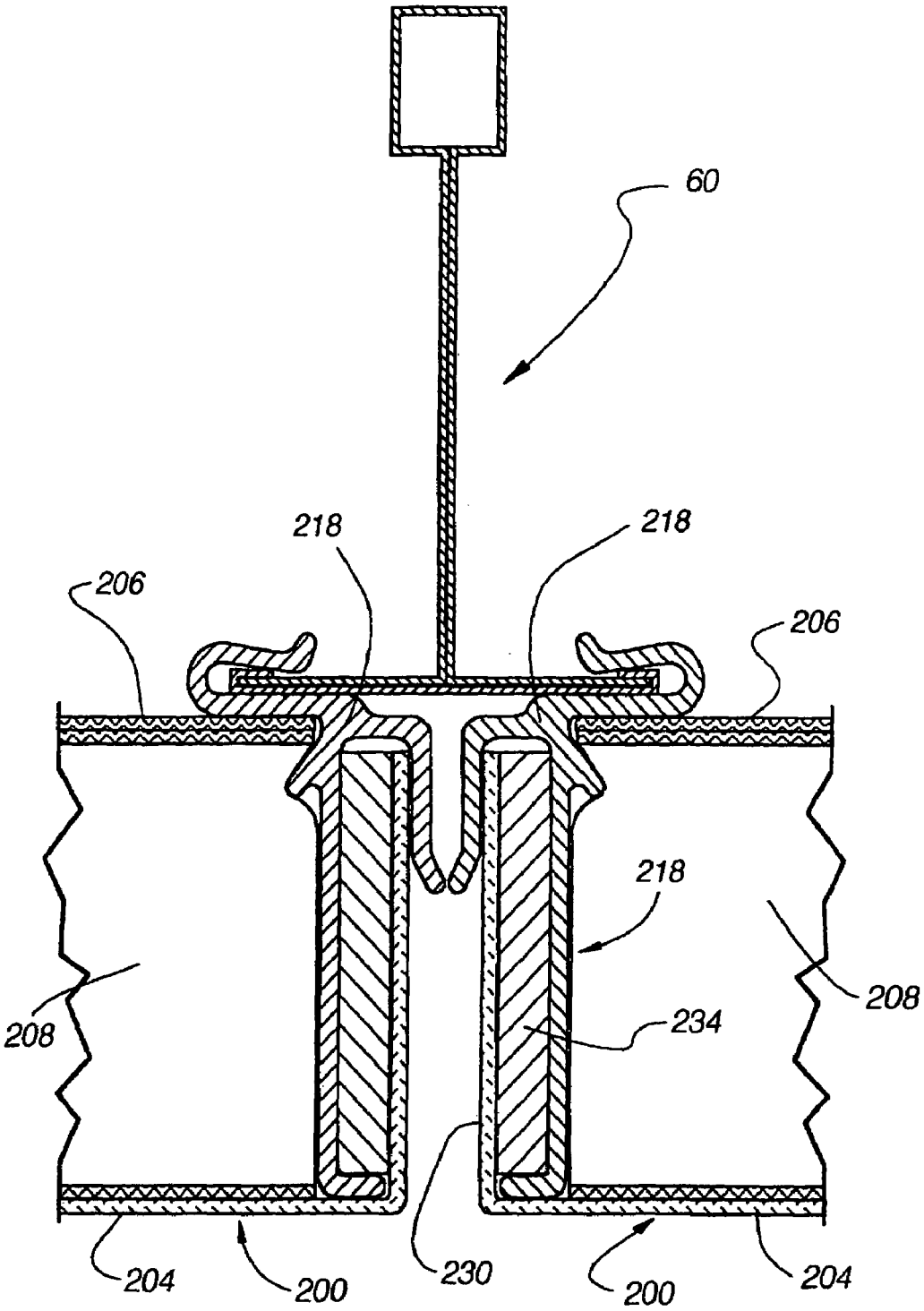
FIG. 86 is a fragmentary vertical section similar to FIG. 85 with the conventional acoustical tiles removed from their supported relationship to the support members.
Figure 88:
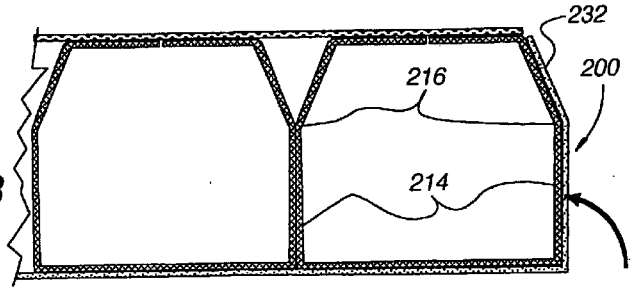
FIG. 88 is a fragmentary vertical section similar to FIG. 87 with the extended outer sheet being folded up and adhesively secured to a longitudinal end of the panel of FIG. 81.
Figure 89:
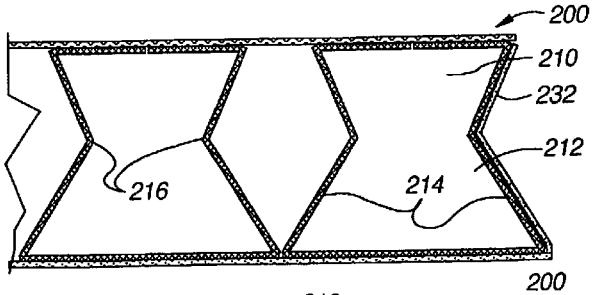
FIG. 89 is a fragmentary vertical section similar to FIG. 88 with the panel slightly compressed.
Figure 90:
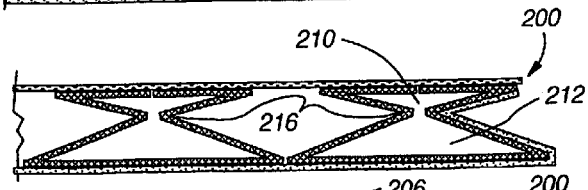
FIG. 90 is a fragmentary vertical section similar to FIG. 89 with the panel further compressed.
Figure 91:
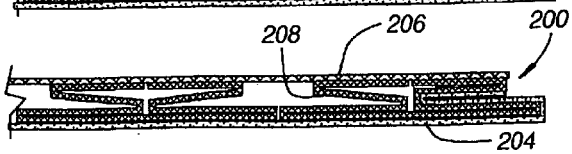
FIG. 91 is a fragmentary vertical section similar to FIG. 90 with the panel substantially fully compressed.

A panel 200 that has been modified to be suspendable from or supportable by the T-shaped support members 60 is shown in FIGS. 80–96 with a plurality of the panels shown in FIG. 8 installed in underlying relationship to existing acoustical panels 202 supported on support members 60. As will be appreciated, each panel 200 is of the general type previously described and as seen in FIGS. 84–86 has an outer sheet 204, a connector sheet 206, and a plurality of parallel cellular dividers 208 therebetween. The cellular dividers are preferably, as previously described, compressible in nature and best seen in FIGS. 87–91 as being formed from individual strips of material that have been creased and folded so as to define elongated tubes having two truncated triangular areas 210 and 212 superimposed upon each other. The dividers 208 have foldable intermediate side walls 214 with fold lines 216, which allow the side walls to either fold inwardly as shown in FIGS. 89–91 or fold outwardly as shown in FIGS. 87 and 88 depending upon a number of conditions including the type of binder used in the fiberglass matting material from which the dividers are made and the treatment of the dividers to heat and cold which will be described in more detail later.

At each end of the panel 200 along the open ends of the cellular dividers 208, a unique clip 218 as seen best in FIGS. 81–86, is secured to the panel. The clips are elongated and preferably extruded members of a rigid material such as aluminum, plastic, or the like and are generally of inverted J-shaped configuration as probably best seen in FIG. 82. They therefore define a vertical main flat body 220 with a lower protruding lip 222 from the bottom edge of the main body. An upper downwardly opening hook-shaped channel 224 extends from the upper edge of the main body. Also along the upper edge is formed a second or horizontally opening hook-shaped channel 226 which protrudes from the main body in the opposite direction as the lip 222 even though it opens in the same direction as the lip 222. An obliquely protruding rib 228 extends downwardly from the upper edge-of the main body beneath the horizontally opening channel 226.

Figure 87:
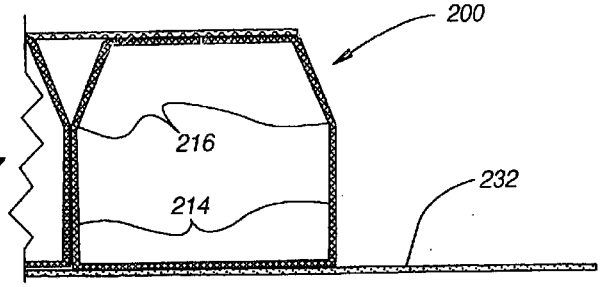
FIG. 87 is a fragmentary transverse vertical section taken through the panel of FIG. 81 showing the outer sheet extended from a longitudinal side edge of the panel.
Figure 92:
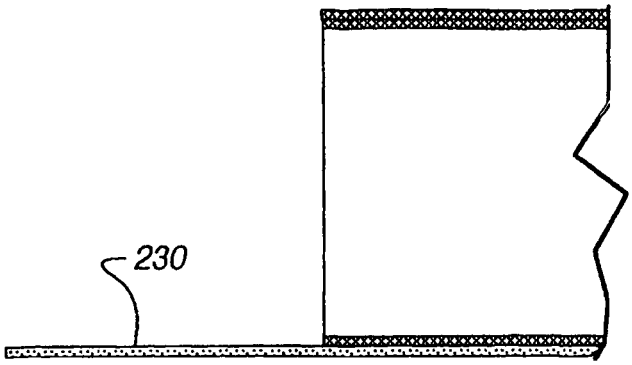
FIG. 92 is a fragmentary longitudinal vertical section showing the outer sheet extending longitudinally from one end of the panel of FIG. 81.
Figure 93:
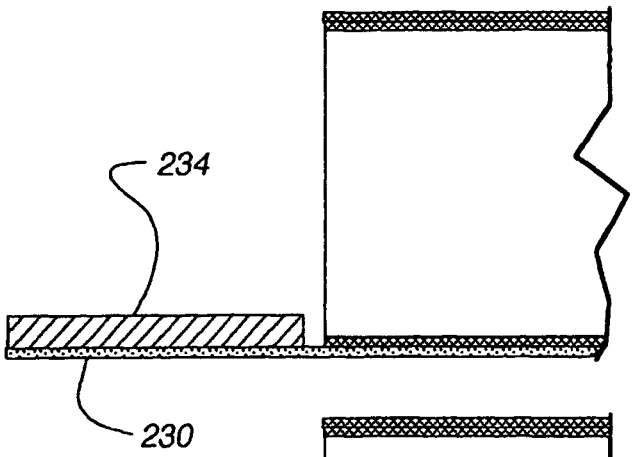
FIG. 93 is a longitudinal fragmentary vertical section similar to FIG. 92 with a stiffener strip supported on the outer sheet extension.
Figure 94:
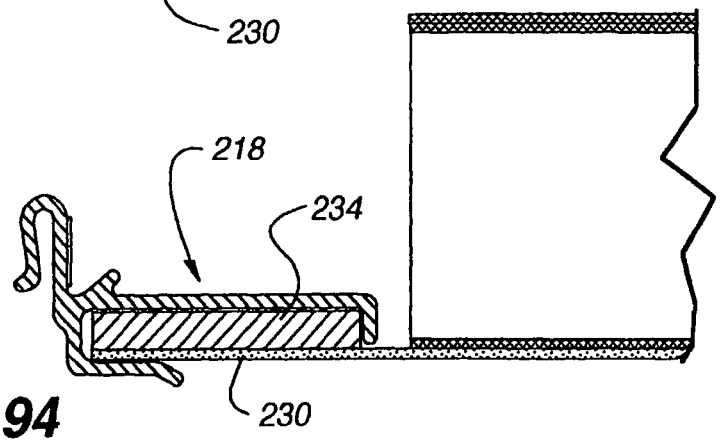
FIG. 94 is a longitudinal fragmentary vertical section similar to FIG. 93 with a clip secured to the outer sheet extension.
Figure 95:
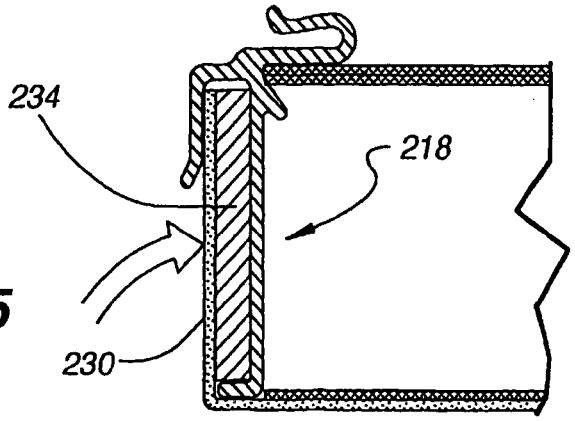
FIG. 95 is a longitudinal fragmentary vertical section similar to FIG. 94 with the clip being folded upwardly to overlie the longitudinal end of the panel.
Figure 92A:
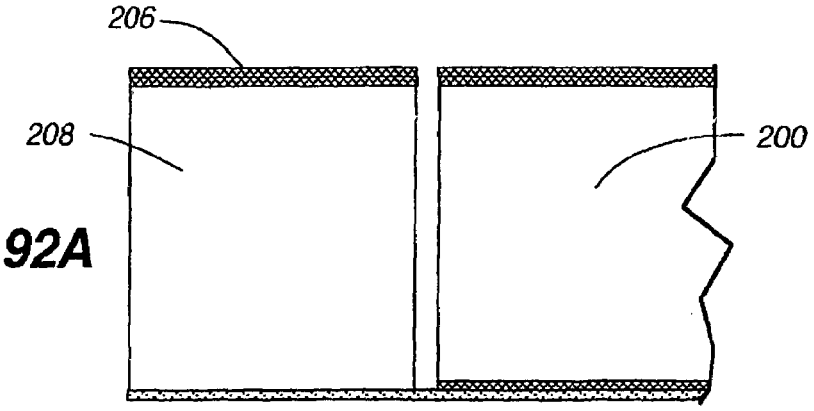
Figure 93A:
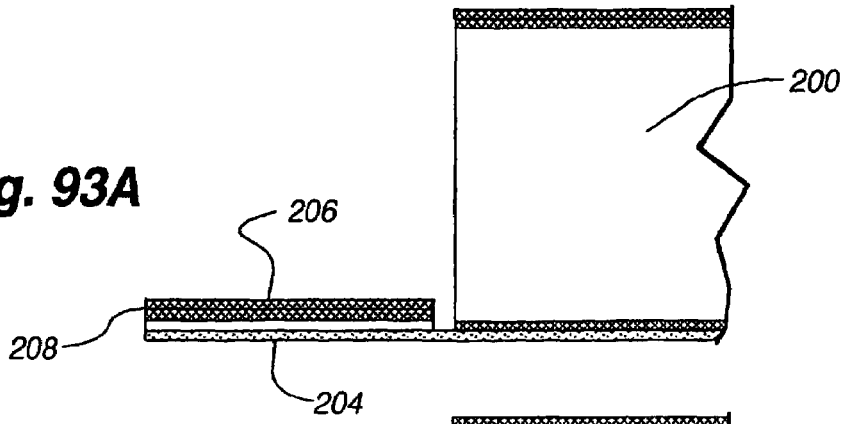
Figure 94A:
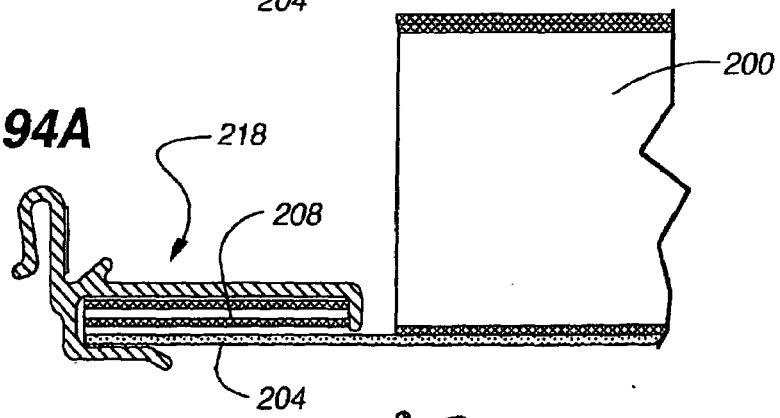
Figure 95A:
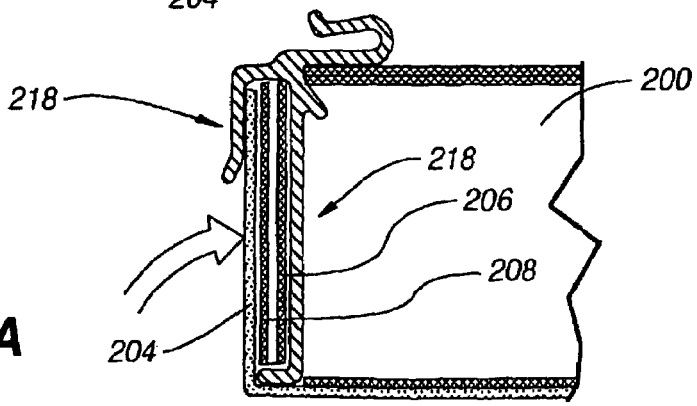
Figure 96:
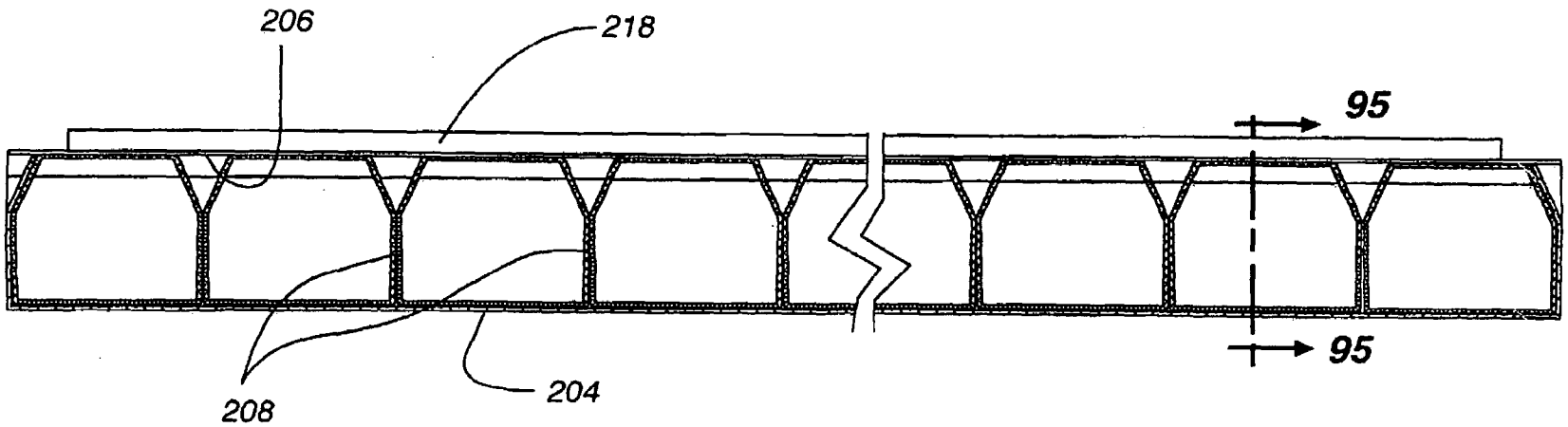
FIG. 96 is an enlarged fragmentary transverse vertical section taken along line 96—96 of FIG. 81.

As shown in FIGS. 92–95, the clip 218 is secured to the end of the panel 200 either by notching the end of the panel, as described previously, so that the outer sheet 204 protrudes longitudinally from opposite ends of the panel or the outer sheet can be made slightly longer and wider than the remainder of the panel so that it naturally protrudes from opposite ends and opposite sides as shown in FIGS. 87 and 92 defining outer sheet longitudinal extensions 230 and outer sheet lateral extensions 232. An elongated straight stiffening strip 234, which might be made of plastic, aluminum, paperboard, or the like, is adhesively bonded to the top surface of the outer sheet longitudinal extension 230 where it protrudes from the ends of the panel and clips are thereafter positioned over the outer sheet longitudinal extensions and the stiffeners as shown in FIG. 94 by inserting the stiffener strips and outer sheet longitudinal extensions into the downwardly opening J-shaped channels 224 adjacent to the main bodies with the lip 222 hanging over the innermost edge of the stiffeners. With the clips so positioned, the outer sheet longitudinal extensions 230, stiffener 234 and clip 218 can be folded upwardly as shown in FIG. 95 until the connector sheet 206 at opposite ends of the panel is received between the horizontally opening J-shape channels 226 and the oblique ribs 228 of the clips. The underside of the horizontally opening J-shaped channels 226 can then be adhesively or otherwise secured to the connector sheet 206 to hold the clip in the position illustrated in FIG. 95.

The oblique rib 228 of each clip projects beneath the connector sheet 206 so as to hold the panel in a fully expanded position. By following the same procedure at each longitudinal end of the panel, it will be appreciated that the ends of each panel will have a clip thereon and the horizontally opening J-shaped channels 226 are positioned to be secured to a flange of the T-shaped support member 60 as shown in FIGS. 84 and 85.

An alternative way for securing a J-shaped clip to ends of the panel is shown in FIGS. 92A–95A.

Figures 81, 82, 83:
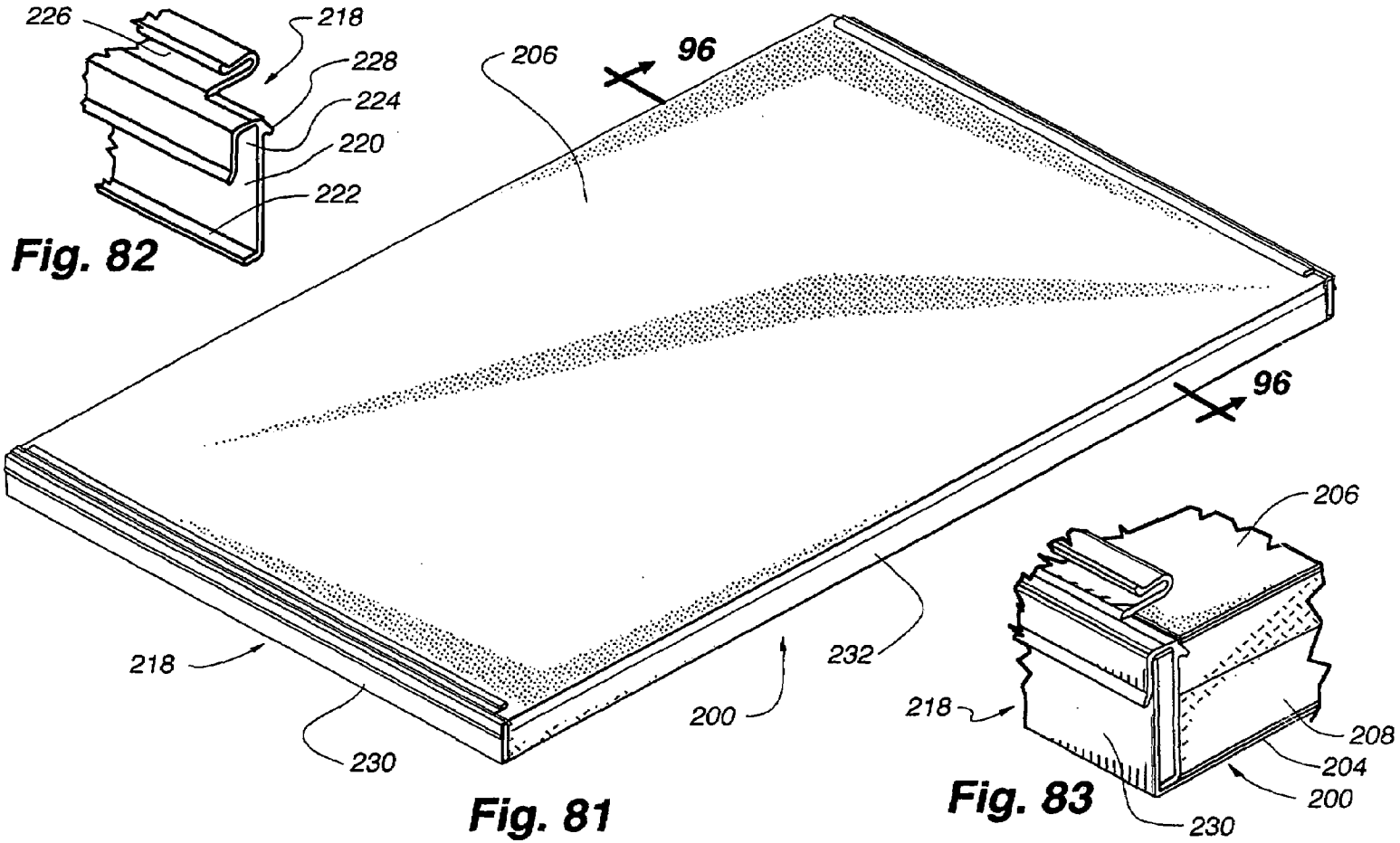
FIG. 81 is an isometric view of a panel for use in the ceiling system shown in FIG. 80.
FIG. 82 is a fragmentary isometric view of an end of a clip member used in the panel of FIG. 81.
FIG. 83 is a fragmentary isometric view of the clip of FIG. 82 mounted on the longitudinal end of the panel shown in FIG. 81.

As shown in FIG. 83, the ends of the horizontally opening J-shaped channels 226 are spaced inwardly from opposite longitudinal ends of the clip 218 to accommodate a T-shaped support member 60 that extends perpendicularly to the T-shaped support member 60 to which the clip is secured. In this manner, the panels can be carried by a conventional gridwork of T-shaped support members in a suspended or supported manner with or without another set of acoustical tiles being supported by the gridwork. In other words, the panels 200 with the clips 218 secured thereto can be used in connection with an existing gridwork or in connection with a new gridwork in exactly the same manner.

A slightly modified clip 240 for the ends of the panels 200 is shown in FIGS. 101–107.

The clip 240 is substantially similar to the previously-described clip 218 shown in FIG. 82, the difference residing simply in the fact that the clip 240 does not have a rib 228. In describing the clip 240 corresponding parts to the clip 218 will be assigned corresponding reference numerals with a prime suffix.

The clip is shown mounted on the compressed end of the panel in FIG. 101 where the remainder of the panel has been allowed to expand and closed into overlying relationship with the open ends of the dividers in FIG. 103. Another difference in the clip shown in FIGS. 101–107 and the clip 218 shown in FIG. 82 resides in the fact that a channel 242 is defined between the downwardly opening channel 224' and the horizontally opening channel 226' with the channel 242 opening in the opposite direction to the channel 226'.

Figure 105:
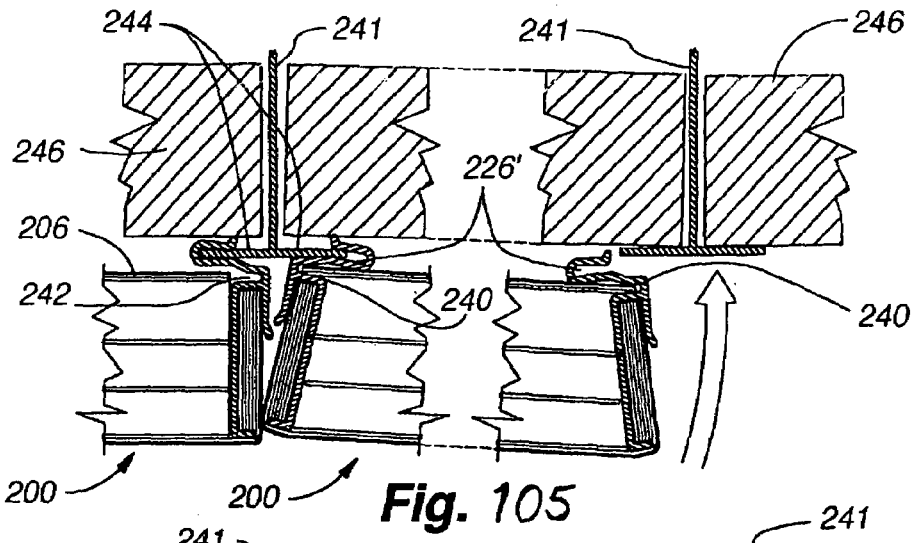
FIG. 105–107 are fragmentary vertical sections showing sequential steps for mounting the panel with a clip of the type shown in FIG. 101 to an inverted T-grid support system.
Figure 106:
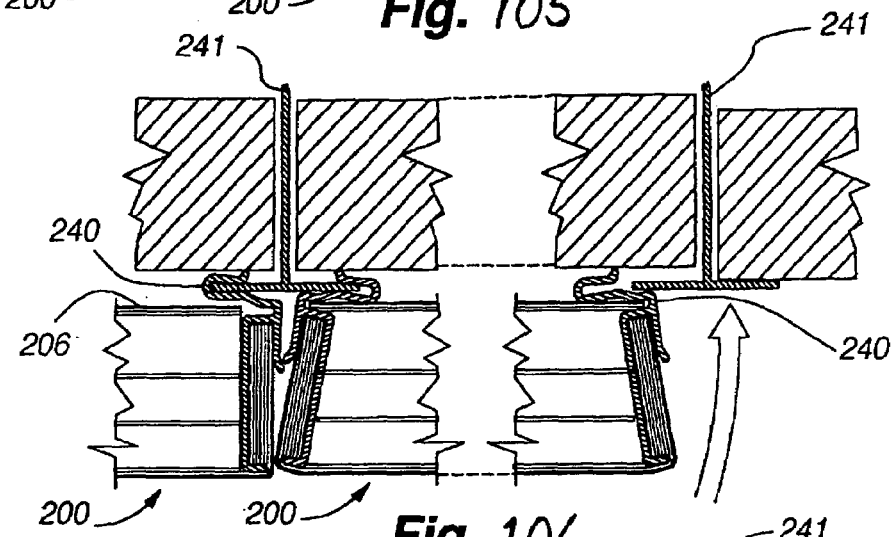
Figure 107:
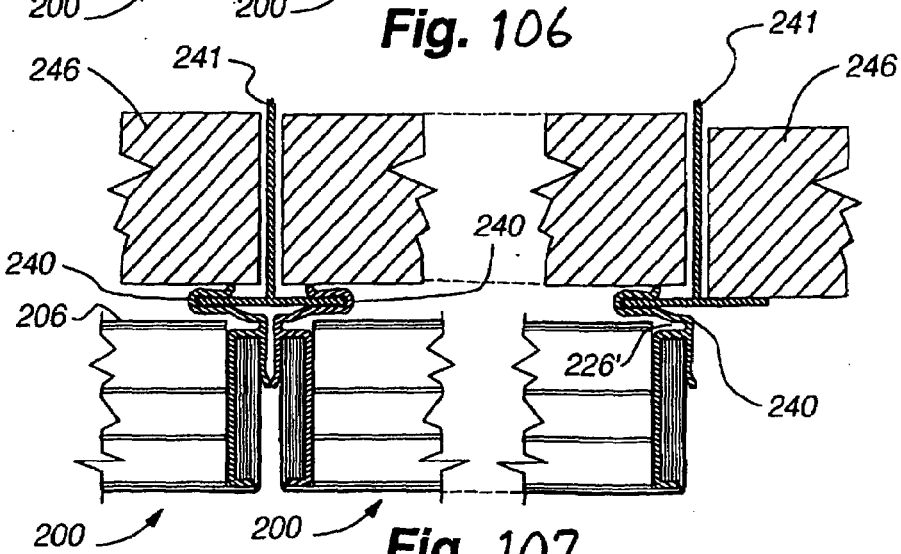

As shown in FIGS. 105–107, when mounting a panel 200 having the clips 240 on the opposite ends thereof on a T-grid system wherein inverted T-shape supports 241 in the system have oppositely directed flanges 244 on which other panels 246 of a ceiling system may be supported, the clip 240 on one end of the panel is advanced onto an associated flange 244 by inserting the flange into the horizontal channel 226'.

Not all support systems for ceiling panels have support members of inverted T-shaped cross section. Rather, as seen in FIGS. 108 and 109 respectively, the support members 245*a*and 245*b* could be of generally U-shaped channeled cross section having inturned lips 247 along the two upper edges of the channeled support members.

Figure 108:
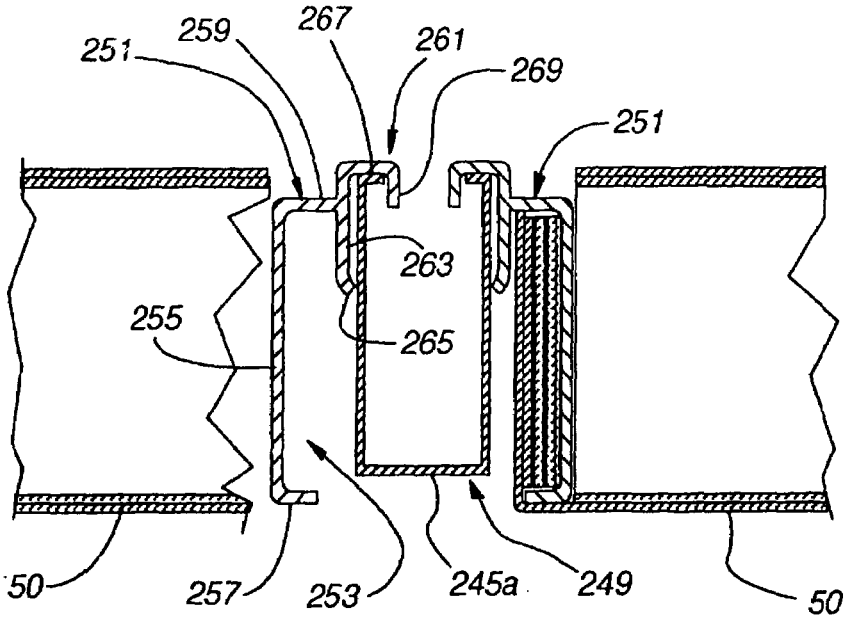
FIG. 108 is a fragmentary vertical section with parts removed illustrating a U-shaped support system and panels with side edge clips for cooperation therewith.
Figure 109:
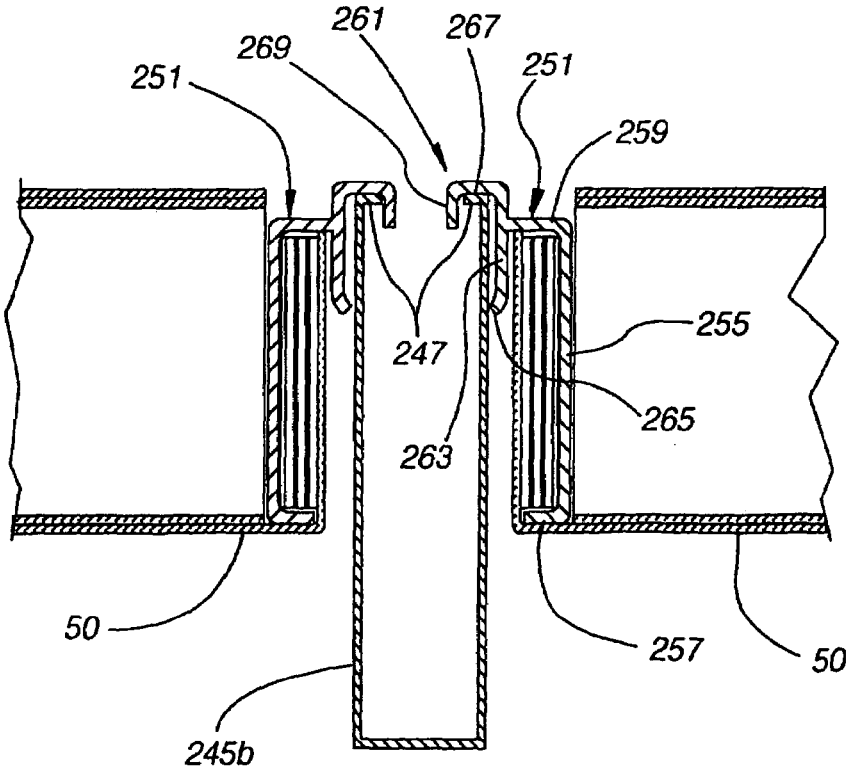
FIG. 109 is a fragmentary vertical section similar to FIG. 108 showing a deeper U-shaped support system.

An edge clip 251 for use with ceiling panels 50 to be supported by a channeled support system is also seen in FIGS. 108 and 109.

Figure 97:
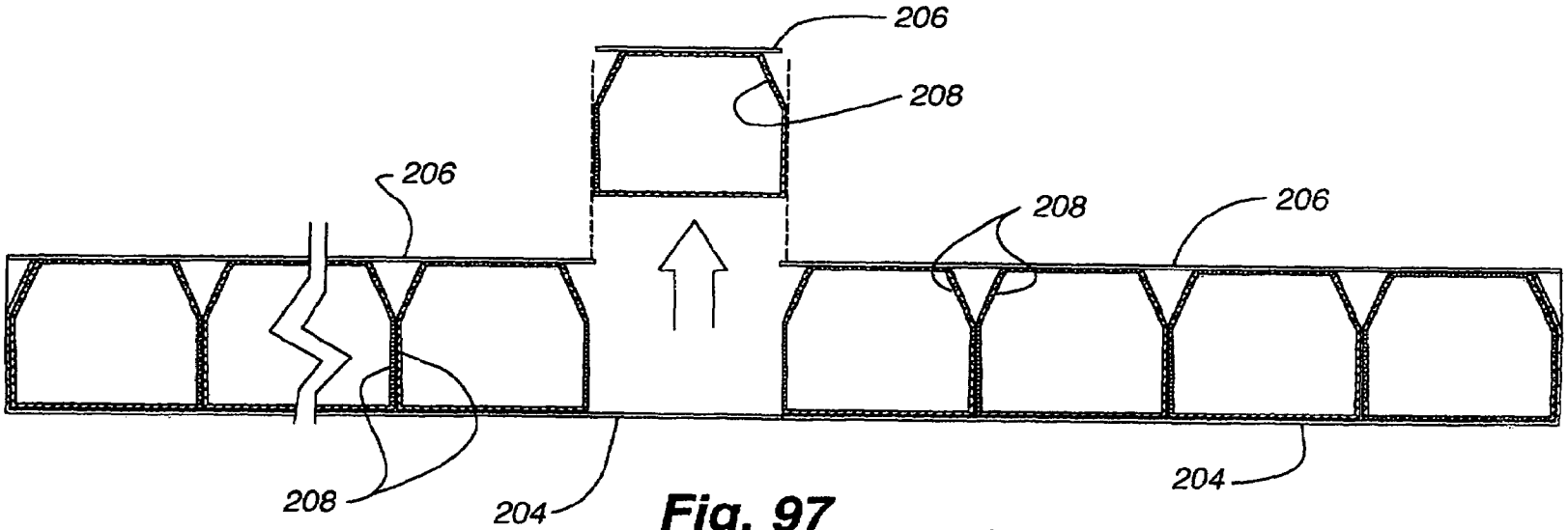
FIG. 97 is a transverse section with portions removed showing one divider being removed to facilitate a folding of the panel.
Figure 98:
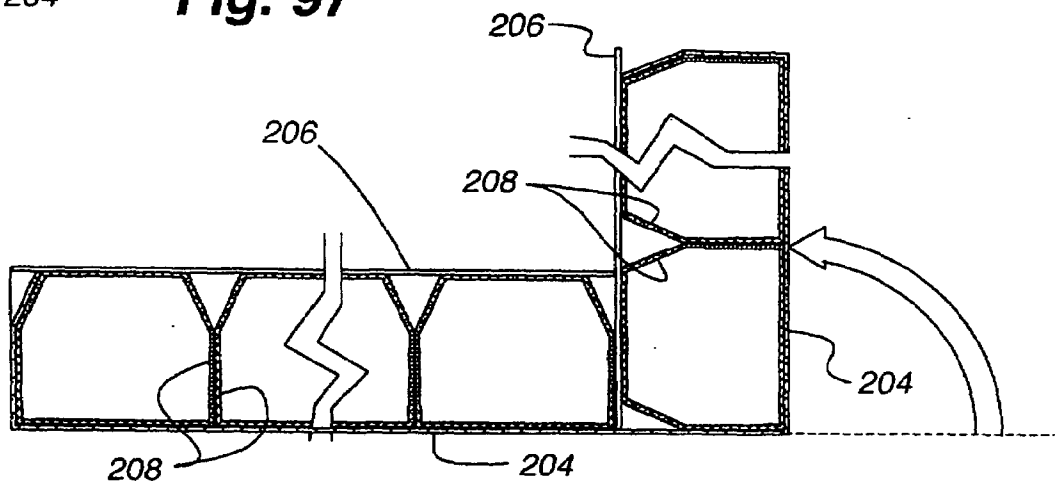
FIG. 98 is a transverse section with portions removed similar to FIG. 97 showing the panel folded about the space where the divider was removed as seen in FIG. 97.

Sometimes it might be desirable to fold a panel around a corner or to form a corner. With the panel used with the packaging and shipping method of the present invention, such a fold or corner can be made in an aesthetically attractive manner as illustrated in FIGS. 97 and 98. It will be seen in FIG. 97 that a divider 208 including the connector sheet 206 across the top thereof can be severed from the remainder of the panel at the location where a fold or bend is desired in the panel leaving the outer sheet 204 where the divider was removed. The remaining portions of the panel can be folded in one direction or the other as illustrated in FIG. 98 so that one remainder portion of the panel is oriented perpendicularly to the other portion with the outer sheet 204 extending continuously around the bend so as to define a fully finished corner for the panel. Such a fold in the panel might be desirable, for example, in a skylight where a window is raised above the ceiling level into an upwardly recessed area and by following the procedure shown in FIGS. 97 and 98, a panel or panels can be folded to extend from the normal ceiling level up into the recessed area of the skylight.

The strips of material from which the dividers 208 are made are folded in an unheated environment and a hot melt adhesive is applied to the strips or to the outer sheet 204 and connector sheet 206 before they are laminated together. Unless the panels 200 are maintained in a compressed configuration such as illustrated in FIGS. 89–91, they will, over some period of time, expand into the configuration of FIG. 88 in which configuration the panel is no longer compressible. This time period over which it takes for the dividers to convert from the configuration of FIGS. 89–91 to the configuration of FIG. 88 is dependent upon a number of factors including the resin used in the material from which the dividers are made and also whether or not heat is applied to the material while the dividers are in the compressed configuration of FIGS. 89–91. By adding heat to the dividers while they are compressed, the time period it takes for them to expand into the configuration of FIG. 88 is lengthened. Also, by increasing the percent of thermoplastic resin used in the material from which the dividers are made, the time in which it takes for the dividers to transform from the configuration of FIG. 89 to the configuration of FIG. 88 can be increased. By way of example only, the time period for the transformation may be varied anywhere from 15 minutes to 32 hours.

Accordingly, when the panels 200 are formed and shipped, they are desirably shipped in a compressed state so that a relatively large number of panels can be packed and shipped in a relatively small container particularly in comparison to conventional acoustical tiles of a fixed depth, i.e., a depth similar to the fully expanded depth of a panel 200 in accordance with the present disclosure for use with the packaging and shipping method of the present invention. Once the panels are removed from the shipping container, however, they expand immediately from the configuration shown in FIG. 91 through the configuration shown in FIG. 90 to the configuration shown in FIG. 89. They will remain in the configuration of FIG. 89 for the above-noted time period after which they will transform into the configuration shown in FIG. 88 where the panel becomes incompressible from a practical standpoint.

During that time period, the panels can be cut to their desired shape and installed in a supporting grid system before the panels become substantially incompressible. They can therefore be flexed for easy insertion into the openings defined between support members in the supporting grid system if inserted before becoming incompressible.

Although the present invention has been described with a certain degree of particularity, it is understood that the present disclosure has been made by way of example, and changes in detail or structure may be made without departing from the spirit of the invention as defined in the appended claims.

What is claimed is:

1. A method of shipping structural panels comprising the steps of:

providing a plurality of structural panels, each of said structural panels having an expanded configuration and a compressed configuration, wherein a thickness of said structural panels in said compressed configuration is less than a thickness of said structural panels in said expanded configuration;

stacking said plurality of structural panels in said expanded configuration;

compressing said stacked plurality of structural panels to place said structural panels into said compressed configuration;

packaging said plurality of stacked structural panels in said compressed configuration;

shipping said packaged plurality of stacked structural panels in said compressed configuration;

unpackaging said packaged plurality of stacked structural panels in said compressed configuration; and heating said plurality of structural panels to expand said structural panels to said expanded configuration.

2. The method of shipping structural panels of claim 1 further including the step of installing said structural panels, subsequent to said step of heating said plurality of structural panels to expand said structural panels to said expanded configuration.

3. The method of shipping structural panels of claim 1 wherein said step of shipping further includes shipping a first plurality of packages of said packaged plurality of stacked structural panels from a first location to a second location, dividing said first plurality of packages into a plurality of sub-pluralities of packages at said second location, shipping said sub-pluralities to respective third locations, dividing said sub-pluralities of packages into further sub-pluralities of packages at said respective third locations, and shipping said further sub-pluralities of packages to respective fourth locations.

4. The method of shipping structural panels of claim 3 wherein said first location is a manufacturing location, said second location is a wholesale location, said respective third locations are retail locations, and said respective fourth locations are sites of installation.

5. The method of shipping structural panels of claim 3 wherein said first plurality of packages constitutes a wholesale quantity of said structural panels and wherein said sub-pluralities of packages constitute a retail quantity.

6. The method of shipping structural panels of claim 3 wherein said first plurality of packages constitutes a wholesale quantity of said structural panels and wherein said sub-pluralities of packages constitute a quantity required at a particular installation location.

7. The method of shipping structural panels of claim 1 wherein each of said structural panels of said plurality includes first and second sheets forming first and second lateral sides of said structural panels, and further includes dividers which form a spaced relationship between said first and second sheets.

8. The method of shipping structural panels of claim 7 wherein said dividers are compressible between an expanded position and a compressed position, corresponding to said expanded configuration and said compressed configuration of said structural panels, respectively.

9. The method of shipping structural panels of claim 7 wherein said dividers are formed by folding sheet material whereby said dividers are biased toward said expanded position and can be urged to said compressed position by lateral forces thereon.

10. The method of shipping structural panels of claim 1 wherein said step of shipping is effected by an order placed electronically.

11. The method of shipping structural panels of claim 10 wherein said order is placed over the internet.

* * * * *